US008262203B2

(12) United States Patent
Hirai et al.

(10) Patent No.: US 8,262,203 B2
(45) Date of Patent: Sep. 11, 2012

(54) LIQUID EJECTING HEAD AND LIQUID EJECTING APPARATUS

(75) Inventors: Eiju Hirai, Okaya (JP); Hiroshi Ito, Suwa (JP); Toshihiro Shimizu, Fujimi-machi (JP); Jiro Kato, Suwa (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 13/177,217

(22) Filed: Jul. 6, 2011

(65) Prior Publication Data

US 2012/0007928 A1 Jan. 12, 2012

(30) Foreign Application Priority Data

Jul. 8, 2010 (JP) ..... 2010-155995

(51) Int. Cl.
*B41J 2/045* (2006.01)

(52) U.S. Cl. ..... 347/71; 347/68; 347/72

(58) Field of Classification Search ..... 347/68–72
See application file for complete search history.

(56) References Cited

U.S. PATENT DOCUMENTS

2009/0284568 A1 11/2009 Yazaki

FOREIGN PATENT DOCUMENTS

JP 2009-172878 8/2009

*Primary Examiner* — Matthew Luu
*Assistant Examiner* — Henok Legesse
(74) *Attorney, Agent, or Firm* — Workman Nydegger

(57) ABSTRACT

A liquid ejecting head comprising: a pressure generating chamber substrate having pressure generating chambers; and a piezoelectric element including first conductive layer, piezoelectric layer, and a second conductive layer provided above the pressure generating chamber substrate, wherein the piezoelectric element includes overlapped areas where the pressure generating chamber and the piezoelectric element overlap one another in plan view, the first conductive layer has a longitudinal direction in a first direction and a second direction orthogonal to the first direction and are provided for each of the overlapped areas, the second conductive layer is provided continuously so as to overlap with a plurality of the pressure generating chambers and includes end areas on the side of the ends of the overlapped areas in the first direction, and the end areas are each reduced in width in the second direction as it goes toward the end in the first direction.

14 Claims, 14 Drawing Sheets

LIQUID EJECTING HEAD AND LIQUID EJECTING APPARATUS

This application claims a priority to Japanese Patent Application No. 2010-155995 filed on Jul. 8, 2010 which is hereby expressly incorporated by reference herein in its entirety.

BACKGROUND

1. Technical Field

The present invention relates to a liquid ejecting head and a liquid ejecting apparatus.

2. Related Art

For example, in liquid ejecting apparatuses such as ink jet printers, a liquid ejecting head having a piezoelectric element for ejecting liquid such as ink is known. The liquid ejecting head of this type is configured to be capable of changing the pressure in a pressure generating chamber formed below a diaphragm by the piezoelectric element which deforms the diaphragm using drive signals or the like. Accordingly, liquid such as ink supplied from nozzle orifices into the pressure generating chamber are ejected. Among the liquid ejecting heads as described above, there is a type having a structure in which a piezoelectric layer is covered with an upper electrode for the purpose of protecting the piezoelectric layer of the piezoelectric element which is vulnerable to destruction due to external factors such as moisture or the like (for example, see JP-A-2009-172878, FIG. 2).

However, when the piezoelectric element as disclosed in JP-A-2009-172878 is driven, the piezoelectric layer of the piezoelectric element is subjected to deformation as a piezoelectric body on the inside of a boundary of a positive area defined by an area in which the upper electrode and a lower electrode are overlapped with each other with the intermediary of the piezoelectric layer therebetween because an electric field is applied thereto. In contrast, the piezoelectric layer of the piezoelectric element is not subjected to deformation as a piezoelectric body on the outside thereof because an electric field is not applied thereto. Therefore, there arises a problem such that a local strain is concentrated on a portion near the boundary of the positive area, and hence high probability of generation of cracks in the piezoelectric layer may be resulted.

SUMMARY

An advantage of some aspects of the invention is that there are provided a liquid ejecting head and a liquid ejecting apparatus improved in durability by restraining production of cracks.

According to an aspect of the invention, there is provided a liquid ejecting head including:

a pressure generating chamber substrate having a plurality of pressure generating chambers which communicate with nozzle orifices, respectively; and a piezoelectric element including first conductive layers, piezoelectric layers, and a second conductive layer provided in sequence above the pressure generating chamber substrate, wherein the piezoelectric element includes overlapped areas where the pressure generating chambers, the first conductive layers, the piezoelectric layers and the second conductive layer overlap one another in plan view, the first conductive layers each have a longitudinal direction in a first direction and a short side direction in a second direction orthogonal to the first direction in the overlapped area and are provided for each of the overlapped areas, the second conductive layer is provided continuously so as to overlap with a plurality of the pressure generating chambers in plan view and includes end areas on the side of at least one of the ends of the overlapped areas in the first direction, and the end areas are each reduced in width in the second direction as it goes toward the end in the first direction.

The term "above" in the invention is used in such a manner that "A specific substance (hereinafter referred to as "A") is formed above another specific substance (hereinafter referred to as "B")". In the description in embodiments of the invention, the term "above" is used as it includes a case where A is formed directly on B and a case where A is formed on B with the intermediary of something. In the same manner, the term "below" includes a case where A is formed directly on the underside of B and a case where A is formed on the underside of B with the intermediary of something.

In the description of the invention, the term "in plan view" means a case of viewing from a direction vertical to the pressure generating chamber substrate.

According to the aspect of the invention, since each of the end areas of the second conductive area is reduced in width in the second direction as it goes toward ends in the first direction, local concentration of the strain on portions near the boundaries of the overlapped areas may be alleviated. Therefore, the liquid ejecting head improved in durability is realized.

It is preferable that each of the end areas is reduced in width from both sides in the second direction as it goes toward the end in the first direction.

In this configuration, the local concentration of the strain on portions near the boundaries of the overlapped areas may further be alleviated. Therefore, the liquid ejecting head improved in durability is realized.

It is preferable that the second conductive layer includes the end areas on the sides of both ends of the overlapped areas.

Accordingly, the local concentration of the strain on the both ends of positive areas near the boundaries can be alleviated. In addition, the stress can easily be well balanced at the both ends of the positive areas. Therefore, the liquid ejecting head improved in durability is realized.

It is preferable that the second conductive layer is provided so that shapes of the overlapped areas become line symmetry.

Accordingly, the stress can further easily be well balanced at the both ends of the positive areas. Therefore, the liquid ejecting head improved in durability is realized.

It is preferable that the second conductive layer includes two end areas on one side and the other side in the first direction in each of the overlapped areas.

Accordingly, the rigidity can easily be well balanced at the both ends of the positive areas. In a manufacturing process, crystal growth of the piezoelectric layers can easily be controlled, so that the strength of the piezoelectric layers is stabilized. Therefore, the liquid ejecting head improved in durability is realized.

It is preferable that the second conductive layer includes extending portions which extend from at least part of an area interposed between the adjacent overlapped areas to both sides in the first direction.

Accordingly, the rigidity can be well balanced further easily at the both ends of the positive areas. Therefore, the liquid ejecting head improved in durability is realized.

It is preferable that a first solid layer and a second solid layer are provided on the second conductive layer, the first solid layer is provided so as to overlap with the overlapped areas on the side of one of the ends of the overlapped areas in the first direction in plan view, and the second solid layer is provided so as to overlap with the overlapped areas on the sides of the other ends of the overlapped areas in the first direction in plan view.

Accordingly reduction of the amount of displacement of the piezoelectric element is achieved. Therefore, the liquid ejecting head improved in durability is realized.

According to a second aspect of the invention, there is provided a liquid ejecting apparatus including the liquid ejecting head according to the first aspect of the invention.

According to the aspects of the invention, since the liquid ejecting head improved in durability is provided, the liquid ejecting apparatus improved in durability is achieved.

BRIEF DESCRIPTION OF THE DRAWINGS

The invention will be described with reference to the accompanying drawings wherein like numbers reference like elements.

DESCRIPTION OF EXEMPLARY EMBODIMENTS

Figure 1:
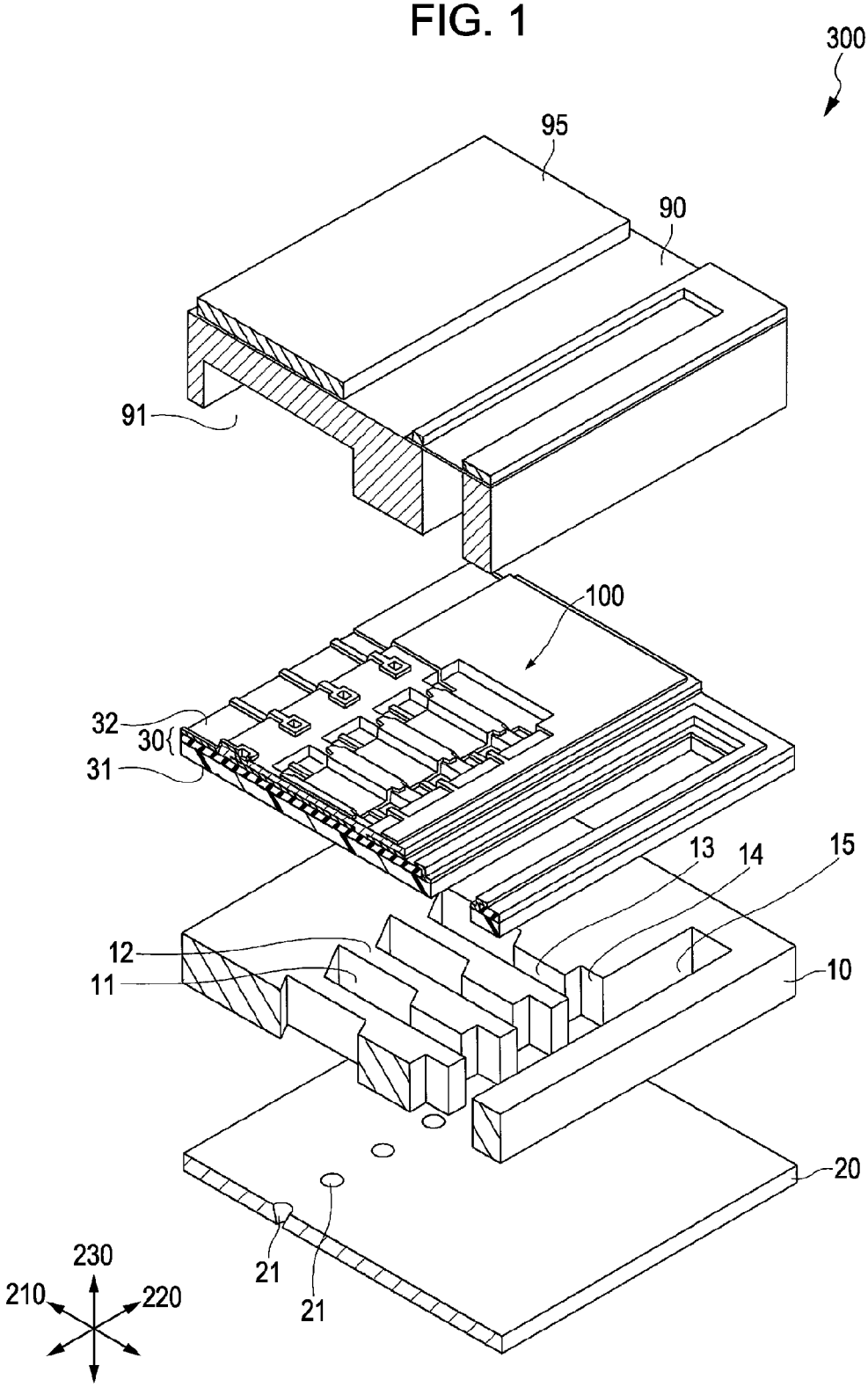
FIG. 1 is an exploded perspective view of a liquid ejecting head 300 according to a first embodiment.

Referring now to the drawings, referred embodiments of the invention will be described in detail. The embodiments described below are not intended to falsely limit the contents of the invention described in appended Claims. All of the configurations described below are not necessarily requirements of the invention.

1. Liquid Ejecting Head 1-1. Structure of Liquid Ejecting Head According to First Embodiment Referring now to the drawings, the structure of a liquid ejecting head according to a first embodiment will be described. FIG. 1 is an exploded perspective view of a liquid ejecting head 300 according to the first embodiment.

The liquid ejecting head 300 according to the first embodiment includes a pressure generating chamber substrate 10 having a plurality of pressure generating chambers 11 which communicate with nozzle orifices 21 respectively, and a piezoelectric element 100. In an example shown in FIG. 1, the liquid ejecting head 300 includes the pressure generating chamber substrate 10, a diaphragm 30 formed above the pressure generating chamber substrate 10, a piezoelectric element 100 formed above the diaphragm 30, a nozzle plate 20 formed below the pressure generating chamber substrate 10, and a sealing plate 90 configured to seal the piezoelectric element 100.

In the description given below, a direction which corresponds to a longitudinal direction of a first conducive layer 40, described later, is defined as a first direction 210, a direction which corresponds to a short side direction of the first conducive layer 40 is defined as a second direction 220, a direction orthogonal to the first direction 210 and the second direction 220 which corresponds to a normal direction of a first surface 31 of the diaphragm 30 is defined as a third direction 230, and terms "above" and "below" are used on the condition that the third direction 230 corresponds to the vertical direction. The term "plan view" is defined to be a "case viewed from a direction vertical to the pressure generating chamber substrate 10", and is used as the same case as the "case viewed from the third direction 230".

The pressure generating chamber substrate 10 includes the pressure generating chambers 11 which communicate with the nozzle orifices 21 as shown in FIG. 1. The pressure generating chamber substrate 10 is formed with a plurality of pressure generating chambers 11 in the third direction 230. As shown in FIG. 1, the pressure generating chamber substrate 10 includes wall portions 12 which constitute side walls of the pressure generating chambers 11. The pressure generating chamber substrate 10 may have a reservoir 15 which communicates with the pressure generating chambers 11 via supply channels 13 and communicating channels 14. The reservoir 15 may be formed with a through hole, not shown, which allows supply of liquid or the like (not only liquid, but also various functional materials adjusted by solvent or dispersing medium to suitable viscosities, or metal flakes and the like are included, hereinafter) from the outside therethrough. In this configuration, by supplying the liquid or the like to the reservoir 15, the liquid or the like can be supplied to the pressure generating chambers 11 via the supply channels 13 and the communicating channels 14. The shape of the pressure generating chamber 11 is not specifically limited. The shape of the pressure generating chamber 11 may be, for example, parallelepiped or rectangular shape when viewed from the third direction 230. The number of the pressure generating chambers 11 is not limited, and may be one or more. The material of the pressure generating chamber substrate 10 is not specifically limited. The pressure generating chamber substrate 10 may be formed of monocrystal silicon, nickel, stainless, stainless steel, glass ceramics, zirconia, various resin materials, and so on.

The nozzle plate 20 is formed below the pressure generating chamber substrate 10 as shown in FIG. 1. The nozzle plate 20 is a plate-shaped member and has the nozzle orifices 21. The nozzle orifices 21 are formed so as to communicate with the pressure generating chambers 11. The shape of the nozzle orifices 21 is not specifically limited as long as they can eject liquid or the like as liquid droplets. With the intermediary of the nozzle orifices 21, the liquid or the like in the pressure generating chambers 11 can be ejected, for example, downward of the nozzle plate 20. The number of the nozzle orifices 21 is not specifically limited, and may be one or more. The material of the nozzle plate 20 is not specifically limited. The nozzle plate 20 may be formed of, for example, monocrystal silicon, nickel, stainless, stainless steel, glass ceramics, various resin materials, and so on.

The diaphragm 30 is formed above the pressure generating chamber substrate 10 as shown in FIG. 1. Therefore, the diaphragm 30 is formed above the pressure generating chambers 11 and the wall portions 12. The diaphragm 30 is a plate-like member. The diaphragm 30 includes a first surface 31, and a second surface 32 opposing the first surface 31 (a back surface if the first surface 31 is considered to be a front surface), and the first surface 31 covers the pressure generating chamber substrate 10. The structure and the material of the diaphragm 30 are not specifically limited. For example, the diaphragm 30 may be formed with a laminated member including a plurality of films as shown in FIG. 1. At this time, the diaphragm 30 may be a laminated member having a plurality of films including, for example, an insulating films such as zirconium oxide or silicon oxide, a metallic film such as nickel, or a film formed of high polymer material such as polyimide. Alternatively, the first conducive layers 40 of the piezoelectric element 100 described later may be configured to serve as the diaphragm 30. The diaphragm 30 constitutes a vibrating portion. In other words, the diaphragm 30 can vibrate (be deformed) by the displacement of the piezoelectric element 100 described later. Accordingly, the volume of the pressure generating chambers 11 formed below may be varied.

The piezoelectric element 100 of the liquid ejecting head 300 according to the first embodiment is formed on the second surface 32 of the diaphragm 30 as shown in FIG. 1. Hereinafter, the piezoelectric element 100 of the liquid ejecting head 300 according to the first embodiment will be described in detail.

Figure 2A:
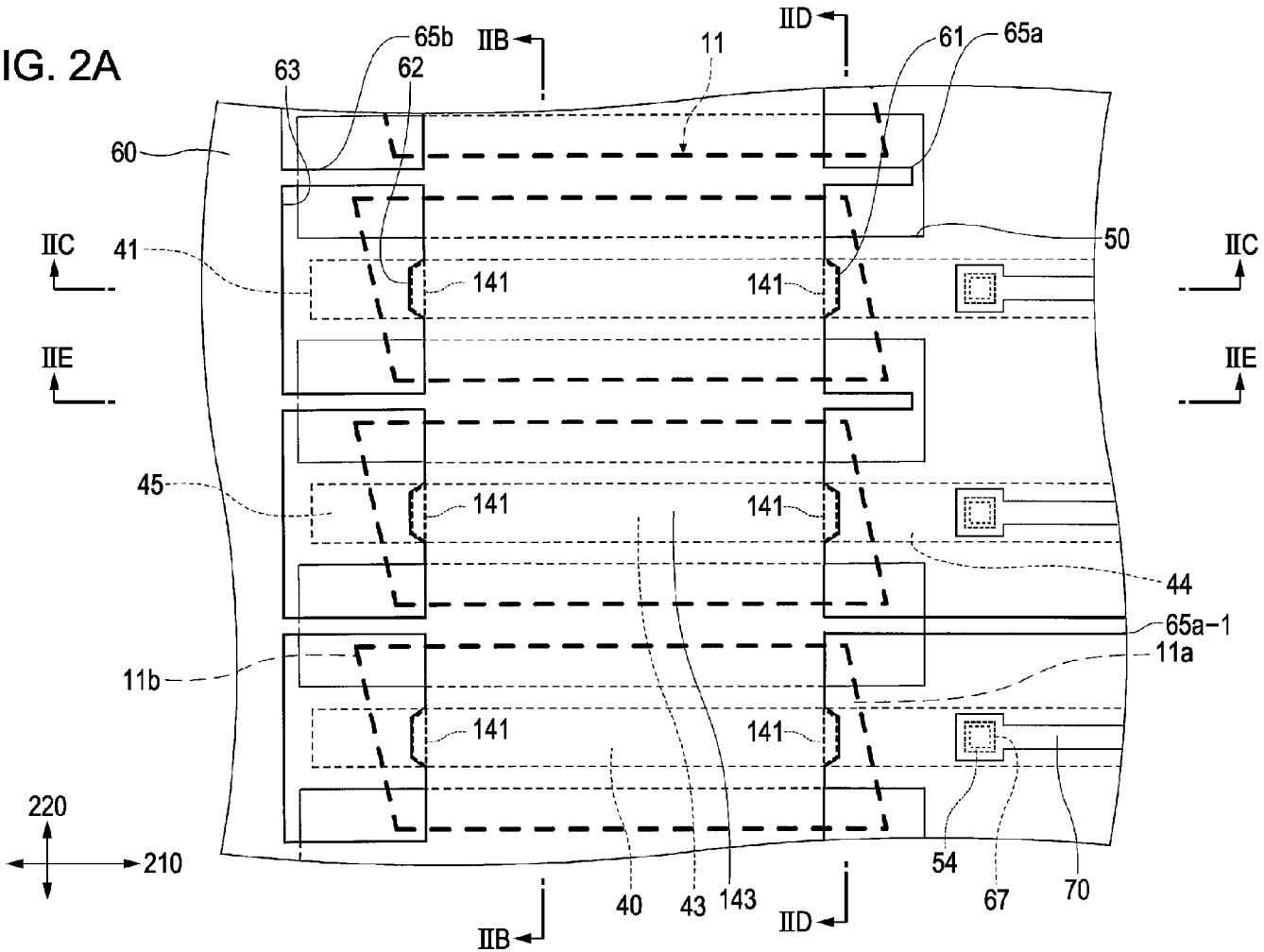
FIG. 2A is a plan view diagrammatically showing a principal portion of the liquid ejecting head 300 according to the first embodiment.
Figure 2B:
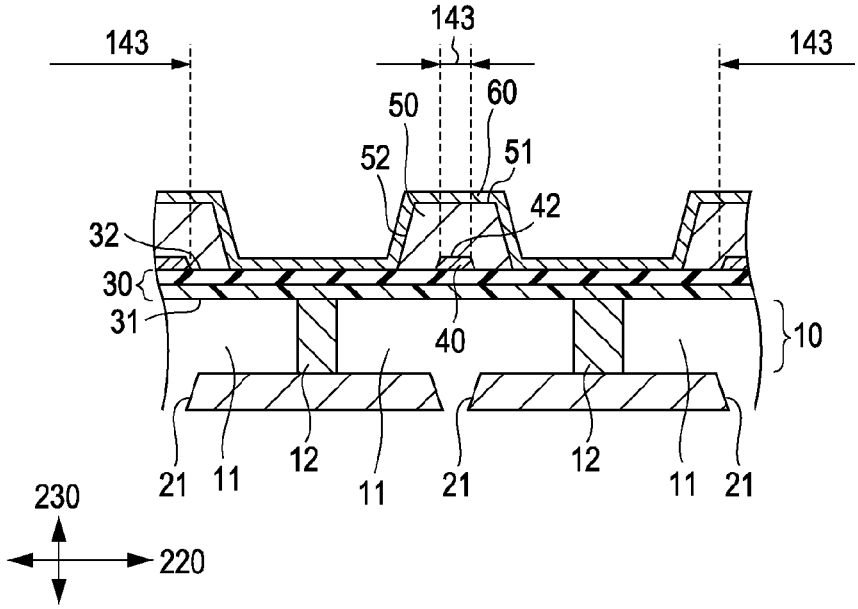
FIG. 2B is a cross-sectional view diagrammatically showing a principal portion of the liquid ejecting head 300 taken along the line IIB-IIB in FIG. 2A.
Figure 2C:
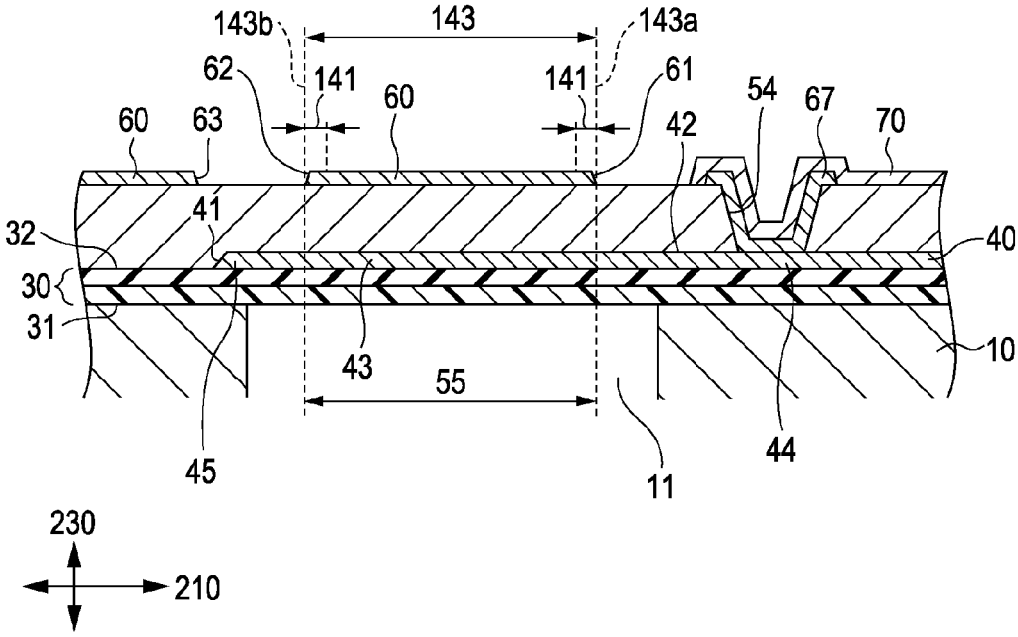
FIG. 2C is a cross-sectional view diagrammatically showing a principal portion of the liquid ejecting head 300 taken along the line IIC-IIC in FIG. 2A.
Figure 2D:
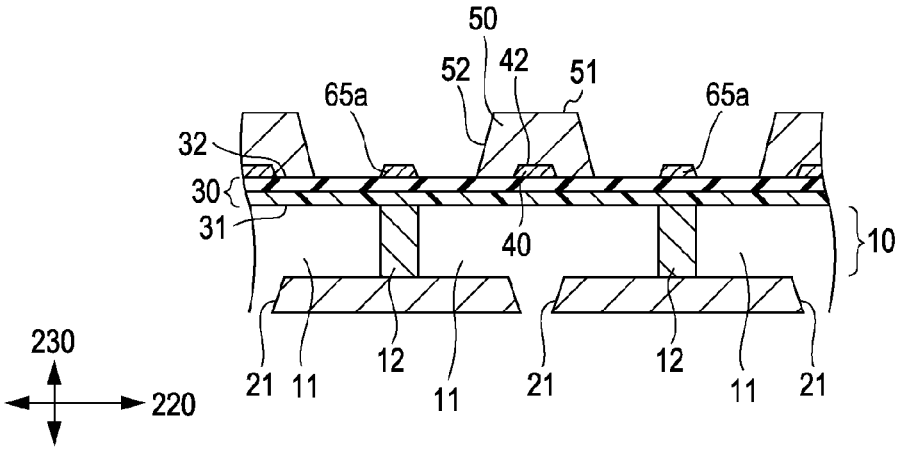
FIG. 2D is a cross-sectional view diagrammatically showing a principal portion of the liquid ejecting head 300 taken along the line IID-IID FIG. 2A.
Figure 2E:
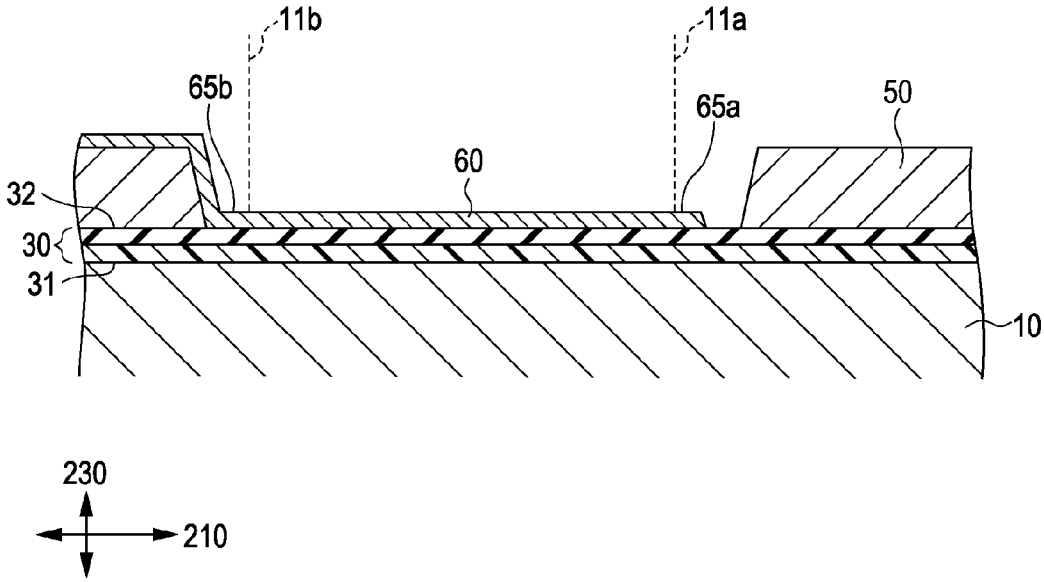
FIG. 2E is a cross-sectional view diagrammatically showing a principal portion of the liquid ejecting head 300 taken along the line IIE-IIE in FIG. 2A.

FIG. 2A is a plan view diagrammatically showing only the pressure generating chamber substrate 10, the diaphragm 30, and the piezoelectric element 100 which are principal portions of the liquid ejecting head 300 according to the first embodiment. FIG. 2B is a cross-sectional view of the principal portions shown in FIG. 2A taken along the line IIB-IIB. FIG. 2C is a cross-sectional view of the principal portions shown in FIG. 2A taken along the line IIC-IIC. FIG. 2D is a cross-sectional view of the principal portions shown in FIG. 2A taken along the line IID-IID. FIG. 2E is a cross-sectional view of the principal portions shown in FIG. 2A taken along the line IIE-IIE.

The structure of the piezoelectric element 100 will be described in detail below. As shown in FIG. 2A to FIG. 2E, the piezoelectric element 100 includes the first conducive layer 40, a piezoelectric layer 50 and second conductive layer 60 provided in sequence above the pressure generating chamber substrate 10.

As shown in FIG. 2A to FIG. 2C, the piezoelectric element 100 includes overlapped areas 143 in which the pressure generating chambers 11, the first conducive layers 40, the piezoelectric layers 50, and the second conductive layer 60 are overlapped with each other in plan view.

The first conducive layer 40 has a longitudinal direction in the first direction 210, and a short side direction in the second direction 220 orthogonal to the first direction 210, and is provided for each of the overlapped areas 143. In the example shown in FIG. 2A to FIG. 2C, the each first conducive layers 40 is provided for each of the pressure generating chamber 11 so as to extend to the outside of an area overlapping with the pressure generating chamber 11 to cover the second surface 32 of the diaphragm 30 at least on one side in the first direction 210, and cover the second surface 32 of the diaphragm 30 within the area overlapping with the pressure generating chamber 11 in the second direction 220 when viewed from the third direction 230.

In the liquid ejecting head 300 according to the first embodiment, the first conducive layers 40 each have an end surface 41, which is one of end surfaces in the first direction 210, at a position out of the areas overlapping with the pressure generating chambers 11 when viewed from the third direction 230 as shown in FIG. 2A and FIG. 2C. The end surface 41 is a side surface of the first conducive layer 40 in the first direction 210. The end surface 41 may be a side surface in a tapered shape. Although not shown, the end surfaces 41 may be positioned within the areas overlapping with the pressure generating chambers 11 when viewed from the third direction 230. In the liquid ejecting head 300 according to the first embodiment, the first conducive layers 40 each have both end portions in the second direction 220 within the areas overlapping with the pressure generating chambers 11 when viewed from the third direction 230 as shown in FIG. 2A and FIG. 2B. In the liquid ejecting head 300 according to the first embodiment, the first conducive layers 40 each have an upper surface 42 as shown in FIG. 2A and FIG. 2C.

In the liquid ejecting head 300 according to the first embodiment, the first conducive layers 40 each includes a first conductive portion 43 provided inside the overlapped area 143, a second conductive portion 44 provided so as to continue from the first conductive portion 43 on the outside of the overlapped area 143 on one side in the first direction 210, and a third conductive portion 45 provided so as to continue from the first conductive portion 43 on the outside of the overlapped area 143 on the other side in the first direction 210 as shown in FIG. 2A and FIG. 2C when viewed from the third direction 230.

The structure and the material of the first conducive layers 40 are not specifically limited. For example, each of the first conducive layers 40 may be made up only of a single layer. Alternatively, each of the first conducive layers 40 may be formed of a laminated member including a plurality of films. Each of the first conducive layers 40 may be formed of, for example, a solid layer containing any one of platinum (Pt), iridium (Ir) and gold (Au) or a conductive oxide electrode such as $LaNiO_3$ or $SrRuO_3$. An adhesive layer may be formed between the first conducive layers 40 and the diaphragm 30 for enhancing adhesiveness therebetween. The adhesive layer may be formed of titanium, titanium oxide, zirconia, or the like.

The piezoelectric layers 50 are formed so as to cover the first conducive layers 40 at least within the areas overlapping with the pressure generating chambers 11 when viewed from the third direction 230. In the liquid ejecting head 300 according to the first embodiment, the piezoelectric layers 50 each have both end portions in the second direction 220 within the areas overlapping with the pressure generating chambers 11 when viewed from the third direction 230 as shown in FIG. 2A and FIG. 2B. In other words, the piezoelectric layers 50 each have a width wider than the width of the first conducive layer 40 and narrower than the width of the pressure generating chamber 11 in the second direction 220. The piezoelectric layers 50 are each formed so as to extend continuously along the first direction 210 to cover the second conductive portion 44 and the third conductive portion 45 of the first conducive layer 40 also on the outside of the area overlapping with the pressure generating chamber 11 when viewed from the third direction 230 as shown in FIG. 2A and FIG. 2C. Although the shape of the piezoelectric layer 50 is not specifically limited, the piezoelectric layer 50 may have an upper surface 51 above the first conducive layer 40 and side surfaces 52 continued from the upper surface 51 in a tapered shape as shown in FIG. 2A and FIG. 2B, for example. Also, as shown in FIG. 2A and FIG. 2B for example, there may be areas where no piezoelectric layer 50 exists in at least part of the areas interposed between the adjacent pressure generating chambers 11 when viewed from the third direction 230.

The piezoelectric layers 50 are formed of polycrystalline substance having piezoelectric properties, and are capable of vibrating in the piezoelectric element 100 by being applied with a voltage. The structure and the material of the piezoelectric layers 50 are not specifically limited as long as they have the piezoelectric properties. The piezoelectric layers 50 may be formed of known piezoelectric materials, and, for example, lead zirconate titanate ($Pb(Zr, Ti)O_3$), bismuth sodium titanate ($(Bi, Na) TiO_3$) may be used.

The piezoelectric layers 50 each may include a opening 54 which exposes part of the second conductive portion 44 on the second conductive portion 44 of the first conducive layer 40 as shown in FIG. 2A and FIG. 2C. The position of the opening 54 is not specifically limited as long as it is on the second conductive portion 44, and apart from the second conductive layer 60 described later. The shape of the opening 54 is not specifically limited as long as the first conducive layer 40 as the second conductive portion can be exposed.

The openings 54 are preferably positioned so as not to be overlapped with the pressure generating chambers 11 for securing symmetry of the diaphragm 30. The distance from the pressure generating chamber 11 is determined by an allowed value of wiring resistance.

The second conductive layer 60 is provided continuously so as to overlap with a plurality of the pressure generating chambers 11 in plan view. In the liquid ejecting head 300 according to the first embodiment, the second conductive layer 60 is formed continuously while covering the piezoelectric layers 50 in the second direction 220 within the areas overlapping at least with the pressure generating chambers 11 when viewed from the third direction 230 as shown in FIG. 2A and FIG. 2B. The second conductive layer 60 is provided continuously in the second direction 220 so as to cover a plurality of the piezoelectric layers 50 respectively as shown in FIG. 2A and FIG. 2B, for example. As shown in FIG. 2A and FIG. 2B, the second conductive layer 60 can cover the upper surfaces 51 and the side surfaces 52 of the piezoelectric layers 50 continuously in part of the piezoelectric layers 50 in the first direction 210.

The second conductive layer 60 includes an end area 141 at least at on the side of one of the ends of the overlapped areas 143 in the first direction 210. Each of the end areas 141 is reduced in width in the second direction 220 as it goes toward the end in the first direction 210. The end area 141 may be reduced in width from both sides in the second direction 220 as it goes toward the end in the first direction 210.

In the liquid ejecting head 300, as shown in FIG. 2A, the end areas 141 are each reduced linearly and monotonously in width from the both ends in the second direction 220 as it goes toward the ends in the first direction 210.

The piezoelectric layers 50 of the piezoelectric element 100 are each subject to deformation as a piezoelectric member on the inside of the boundary of the overlapped area 143 and are not subject to deformation as the piezoelectric member on the outside thereof when viewed from the third direction 230. Therefore, a local strain is liable to be concentrated on portions near the boundary of the overlapped areas 143, specifically, on corners of the boundaries when viewed from the third direction 230. In the liquid ejecting head 300 according to the first embodiment, the angle at the boundaries of the overlapped areas 143 is an obtuse angle when viewed from the third direction 230, the local concentration of the strain on the portions near the boundaries of the overlapped areas 143 can be alleviated. Therefore, the liquid ejecting head improved in durability is realized.

As shown in FIG. 2A, the second conductive layer 60 may include the end areas 141 on both end sides of the overlapped areas 143 in the first direction 210. Accordingly, the local concentration of the strain on the both ends of the overlapped areas 143 near the boundaries can be alleviated. In addition, the stress can easily be well balanced at the both ends of the overlapped areas 143. Therefore, the liquid ejecting head improved in durability is realized.

Furthermore, the second conductive layer 60 may be provided so that the shapes of the overlapped areas 143 become line symmetry in plan view as shown in FIG. 2A. Accordingly, the stress can be well balanced further easily at the both ends of the overlapped areas 143. Therefore, the liquid ejecting head improved in durability is realized.

The second conductive layer 60 may have two end portions 61 and 62 on one side and the other side in the first direction 210 in the overlapped areas 143. In other words, the second conductive layer 60 may be provided to cover at least part of the piezoelectric layers 50 so as to overlap with part of the first conducive layers 40 in the first direction 210 in the overlapped areas 143 as shown in FIGS. 2A and 2B. In the liquid ejecting head 300 according to the first embodiment, the end portions 61 and 62 are arranged so as to overlap with the upper surfaces 42 of the first conducive layers 40 when viewed from the third direction 230 as shown in FIG. 2A and FIG. 2C. The two end portions 61 and 62 are end surfaces in the first direction 210 formed in the area overlapping with the pressure generating chambers 11 when viewed from the third direction 230. The end portions 61 are end surfaces on the side where the end surfaces 41 of the first conducive layers 40 are formed, and the end portions 62 are end surfaces on the side where the openings 54 are formed. In the liquid ejecting head 300 according to the first embodiment, the width of the second conductive layer 60 in the first direction 210 within the areas overlapping with the pressure generating chambers 11 is smaller than the widths of the first conductive portions 43 of the first conducive layers 40 in the first direction 210 when viewed from the third direction 230 as shown in FIG. 2A and FIG. 2C. As shown in FIGS. 2A and 2C, there may be provided openings 63 having no second conductive layer 60 provided thereon. The end portions 62 may constitute part of the openings 63 respectively.

In the liquid ejecting head 300 according to the first embodiment, the second conductive layer 60 is formed so that the end portions 61 and the end portions 62 overlap the upper surfaces 42 of the first conducive layers 40 within the areas overlapping with the pressure generating chambers 11 when viewed from the third direction 230 as shown in FIGS. 2A and 2C. As shown in FIG. 2A and FIG. 2C, the positions of end portions 143*a* of the overlapped area 143 on one side in the first direction 210 can be defined by the positions of the end portions 61 of the second conductive layer 60. The positions of the end portions 143*b* of the overlapped areas 143 on the other side in the third direction 230 can be defined by the positions of the end portions 62 of the second conductive layer 60. It means that the overlapped areas 143 can be formed over the upper surfaces 42 of the first conductive portions 43 of the first conducive layers 40. In other words, the overlapped area 143 is not formed on the end surfaces 41 of the first conducive layers 40.

In this manner, by the provision of the two end portions 61 and 62 on the second conductive layer 60 on one side and the other side in the first direction 210 in the overlapped areas 143, the overlapped areas 143 can be well balanced in rigidity at both ends thereof. Since the first conducive layers 40 exist below the piezoelectric layers 50 which correspond to the overlapped areas 143, crystal growth of the piezoelectric layers 50 can easily be controlled and the strength of the piezoelectric layer 50 is stabilized. Therefore, the liquid ejecting head improved in durability is realized.

In addition, the second conductive layer 60 may have extending portions 65*a* and 65*b* each extend from at least part of areas interposed between the adjacent overlapped areas 143 to both sides in the first direction 210. Accordingly, the rigidity can be well balanced further easily at the both ends of the overlapped areas 143. Therefore, the liquid ejecting head improved in durability is realized.

In the liquid ejecting head 300 according to the first embodiment, the extending portions 65*a* and 65*b* extend to the outside of the ends (first side 11*a* and the second side 11*b*) of the pressure generating chambers 11 in the first direction 210 when viewed from the third direction 230 as shown in FIG. 2A and FIG. 2E. Accordingly, the rigidity can be well balanced in the first direction 210 further easily. Although the extending portions 65*a* each have a length to an area where no piezoelectric layer 50 exists in the example shown in FIGS. 2A and 2E, it may extend to an area overlapping with the piezoelectric layers 50.

In the liquid ejecting head 300, the extending portion 65*a* and 65*b* are provided at positions which do not overlap with the pressure generating chambers 11 when viewed from the third direction 230 as shown in FIG. 2A and FIG. 2D. Accordingly, vibrations of the diaphragm 30 can hardly be hindered by the extending portion 65*a* and 65*b*.

In the liquid ejecting head 300 according to the first embodiment, the extending portion 65*a* and 65*b* are provided in line symmetry with respect to the second direction 220 as an axis of symmetry within ranges from one end to the other end of the pressure generating chambers 11 in the first direction 210 when viewed from the third direction 230 as shown in FIG. 2A and FIG. 2E. Accordingly, since the rigidity is substantially well balanced in the first direction 210, the liquid ejecting head improved in rigidity is realized.

The second conductive layer 60 is electrically connected to a common electrode (not shown), and at least parts of the extending portions 65*a* and 65*b* may be electrically connected to the common electrode at extremities of extensions thereof. In the example shown in FIG. 2A and FIG. 2E, all the extending portion 65*b* are electrically connected to the common electrode at the extremities of extensions thereof. In the example shown in FIG. 2A and FIG. 2E, an extending portion 65*a*-1 which is part of the extending portions 65*a* are electrically connected to the common electrode at the extremity of extension. By the electrical connection of the second conductive layer 60 to the common electrode, and the electrical connection of at least parts of the extending portions 65*a* and 65*b* to the common electrode at the extremities of extensions thereof, a resistance value between the second conductive layer 60 and the common electrode can be reduced.

The structure and the material of the second conducive layers 60 are not specifically limited. For example, the second conductive layers 60 may be made up only of a single layer. Alternatively, the second conducive layers 60 may be formed of a laminated member including a plurality of films. The second conductive layers 60 are each formed of a layer having conductivity and constitute an upper electrode in the piezoelectric element 100. The second conducive layers 60 may be, for example, a solid layer containing platinum (Pt), iridium (Ir), gold (Au) or the like. The second conductive layers 60 are capable of covering portions of the piezoelectric layers 50 including the overlapped areas 143 completely. In this configuration, the piezoelectric layers 50 of the overlapped areas 143 can be protected from external factors such as water content (moisture) or the like in the atmospheric air.

Third conductive layers 67 may be formed so as to cover at least the openings 54 as shown in FIG. 2A and FIG. 2C. The third conductive layers 67 may be formed so as to cover at least the second conductive portion 44 (the first conducive layers 40) (not shown). The structure and the material of the third conductive layers 67 are not specifically limited. The third conductive layers 67 may be of any type of layers as long as it has conductivity and may be the same as the second conductive layers 60. By forming the third conductive layers 67, the surface of the second conductive portions 44 of the first conducive layers 40 in the openings 54 can be protected in the manufacturing process. The detailed description will be given in conjunction with a manufacturing method. Since the third conductive layers 67 are not an essential configuration of the piezoelectric element 100, the third conductive layers 67 may not be formed on the first conducive layers 40 in the openings 54 (not shown).

As shown in FIGS. 2A and 2C, fourth conductive layers 70 are formed so as to be electrically connected to the respective third conductive layers 67. In other words, the fourth conductive layers 70 are electrically connected to the first conductive portion 43 via the second conductive portion 44, respectively. The fourth conductive layers 70 may be formed so as to cover at least the openings 54. The shape of the fourth conductive layers 70 is not specifically limited as long as they are formed at least in the openings 54. The structure and the material of the fourth conductive layers 70 are not specifically limited. For example, the fourth conductive layers 70 may be made up only of a single layer. Alternatively, each of the fourth conductive layers 70 may be formed of a laminated member including a plurality of films. Each of the second conductive layers 70 is formed of a layer having conductivity and constitutes a lead wire to the lower electrode in the piezoelectric element 100. The fourth conductive layers 70 may be, for example, a solid layer containing gold (Au), nickel-chrome alloy (Ni—Cr), platinum (Pt), iridium (Ir), copper (Cu), nickel (Ni) or the like. The fourth conductive layers 70 may be connected to an external drive circuit 95. Accordingly, the first conducive layers 40 can be electrically connected, for example, to the external drive circuit 95 via the fourth conductive layers 70.

The liquid ejecting head 300 according to the first embodiment may have the sealing plate 90 which is capable of sealing the piezoelectric element 100 as shown in FIG. 1. The sealing plate 90 includes a sealed area 91 which is capable of sealing the piezoelectric element 100 in a predetermined space area. The sealed area 91 may be a space area which does not impair a vibrating movement of the piezoelectric element 100. The structure and the material of the sealing plate 90 are not specifically limited. For example, the sealing plate 90 may be formed of monocrystal silicon, nickel, stainless, stainless steel, glass ceramics, various resin materials, and so on. The liquid ejecting head 300 may be formed of various resin materials or various metallic materials, and may have a housing which can accommodate the above-described configurations (not shown).

1-2. Structure According to Second Embodiment

Figure 3:
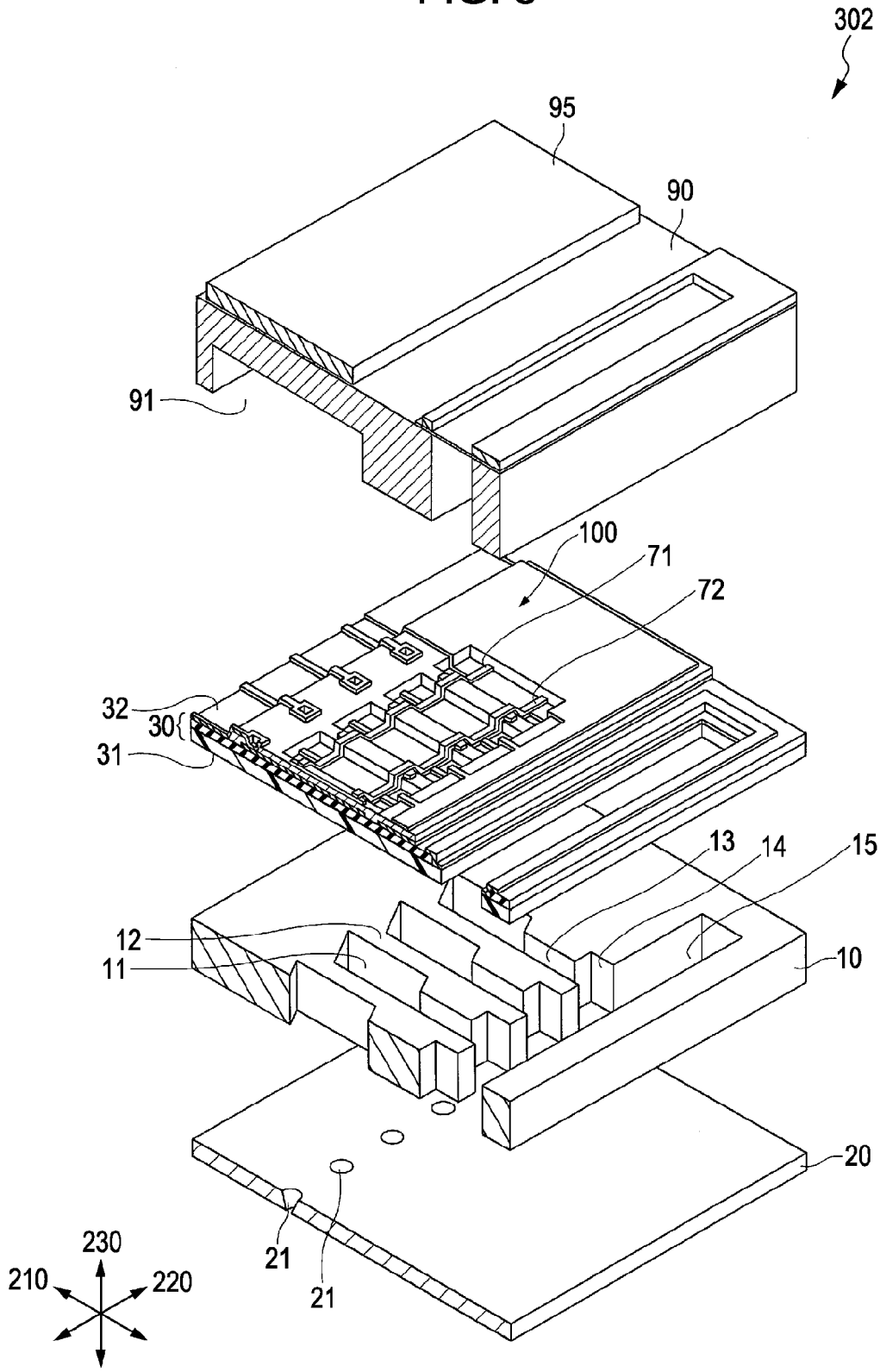
FIG. 3 is an exploded perspective view of a liquid ejecting head 302 according to a second embodiment.
Figure 4A:
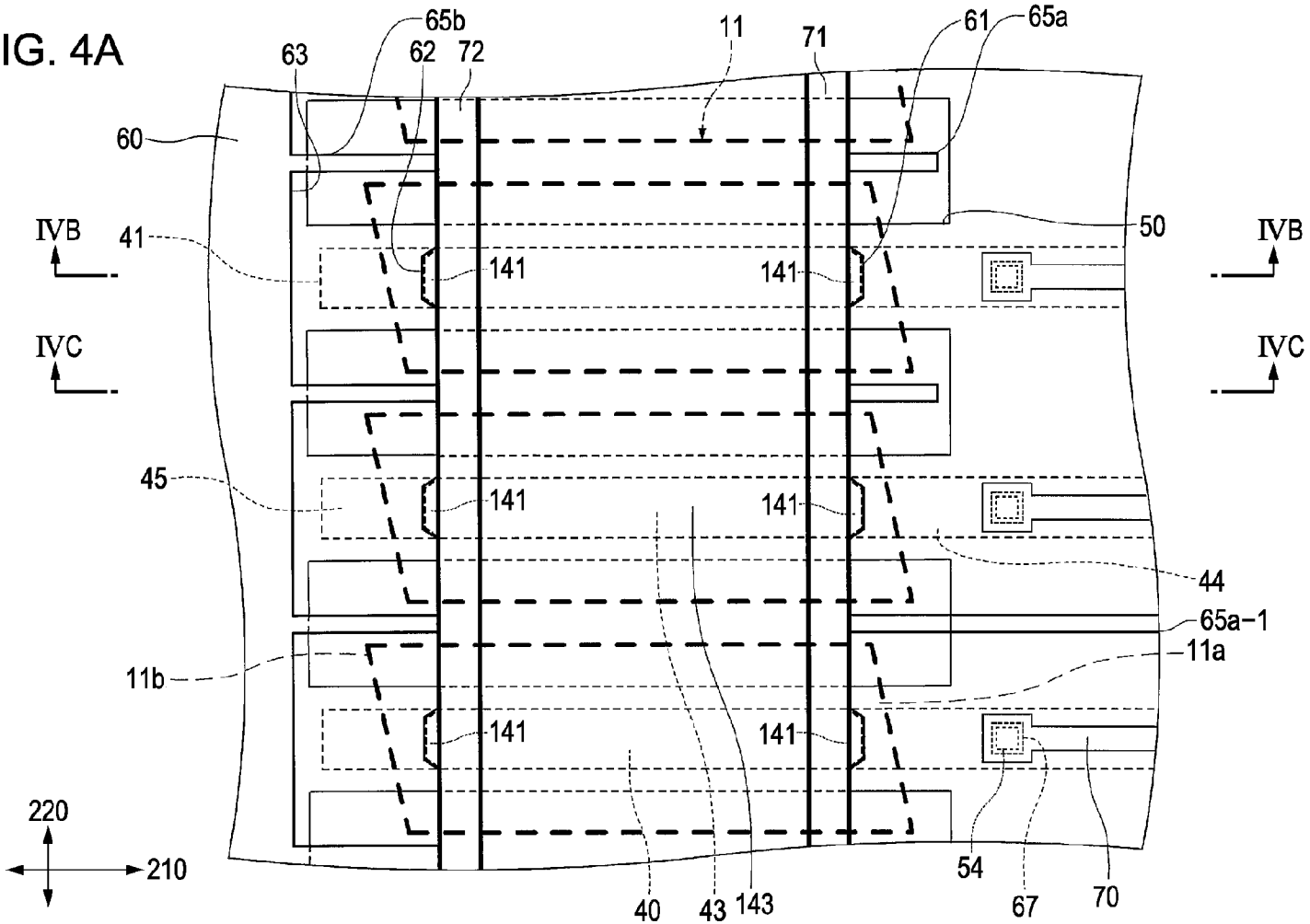
FIG. 4A is a plan view diagrammatically showing a principal portion of the liquid ejecting head 302 according to the second embodiment.
Figure 4B:
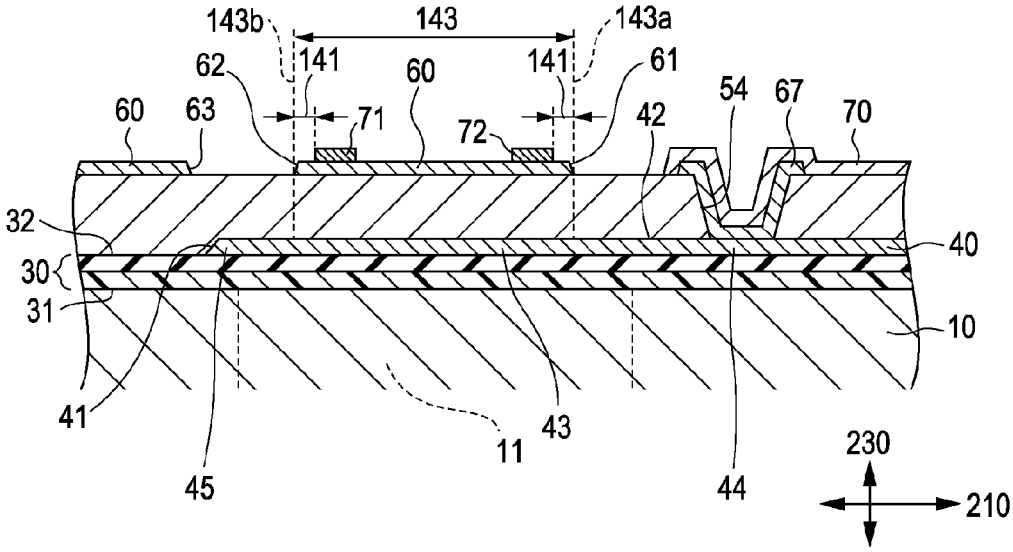
FIG. 4B is a cross-sectional view diagrammatically showing a principal portion of the liquid ejecting head 302 taken along the line IVB-IVB in FIG. 4A.
Figure 4C:
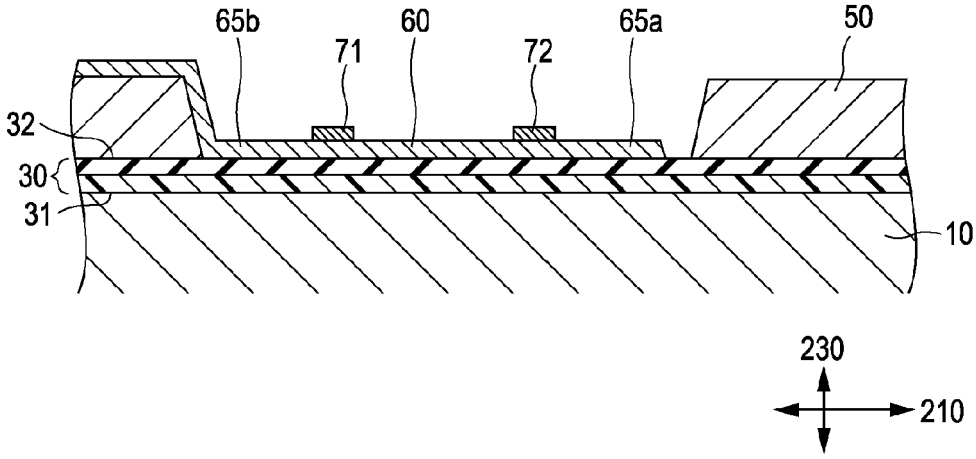
FIG. 4C is a cross-sectional view diagrammatically showing a principal portion of the liquid ejecting head 302 taken along the line IVC-IVC in FIG. 4A.

FIG. 3 is an exploded perspective view of a liquid ejecting head 302 according to a second embodiment. FIG. 4A is a plan view diagrammatically showing only the pressure generating chamber substrate 10, the diaphragm 30, and the piezoelectric element 100 which are principal portions of the liquid ejecting head 302 according to the second embodiment. FIG. 4B is a cross-sectional view of the principal portions shown in FIG. 4A taken along the line IVB-IVB. FIG. 4C is a cross-sectional view of the principal portions shown in FIG. 4A taken along the line IVC-IVC. The structure shown in FIG. 2B and FIG. 2D is common to the liquid ejecting head 300 according to the first embodiment described above, and detailed description will be omitted.

As shown in FIG. 3, FIG. 4A, FIG. 4B, and FIG. 4C, the liquid ejecting head 302 according to the second embodiment includes a first solid layer 71 and a second solid layer 72 provided on the second conductive layer 60. The first solid layer 71 is provided so as to overlap with the overlapped areas 143 on one end side of the overlapped areas 143 in the first direction 210 in plan view. The second solid layer 72 is provided so as to overlap with the overlapped areas 143 on the other end side of the overlapped areas 143 in the first direction 210 in plan view.

In this manner, by the provision of the first solid layer 71 and the second solid layer 72, the amount of displacement of the piezoelectric element 100 can be restrained. Therefore, the liquid ejecting head improved in durability is realized.

The first solid layer 71 and the second solid layer 72 may be provided so as to overlap with at least part of the end areas 141. In the example shown in FIG. 3, FIG. 4A, FIG. 4B and FIG. 4C, the first solid layer 71 and the second solid layer 72 are provided so as to overlap with the entire end area 141. With the provision of the solid layers 71 and 72, the liquid ejecting head further improved in durability is realized.

The structure and the material of the first solid layer 71 and the second solid layer 72 are not specifically limited. For example, the first solid layer 71 and the second solid layer 72 may be made up only of a single layer. Alternatively, the first solid layer 71 and the second solid layer 72 may be formed of a laminated member including a plurality of films. The first solid layer 71 and the second solid layer 72 may be formed of a layer having conductivity. When the first solid layer 71 and the second solid layer 72 are formed of the layer having conductivity, the first solid layer 71 and the second solid layer 72 may be electrically connected to the second conductive layer 60. By the electrical connection of the first solid layer 71 and the second solid layer 72 with the second conductive layer 60, the first solid layer 71 and the second solid layer 72 and the second conductive layer 60 function integrally as an electrode of the piezoelectric element 100. Accordingly, the resistance of the electrode of the piezoelectric element 100 can be reduced.

The first solid layer 71 and the second solid layer 72 may be, for example, a solid layer containing gold (Au), nickel-chrome alloy (Ni—Cr), platinum (Pt), iridium (Ir), nickel (Ni), tungsten (W), copper (Cu) or the like. Preferably, the first solid layer 71 and the second solid layer 72 may be formed of gold. The first solid layer 71 and the second solid layer 72 may be formed of the same material as the fourth conductive layers 70. The film thickness of the first solid layer 71 and the second solid layer 72 may be adjusted as needed.

1-3. Structure According to Modification

Figure 5:
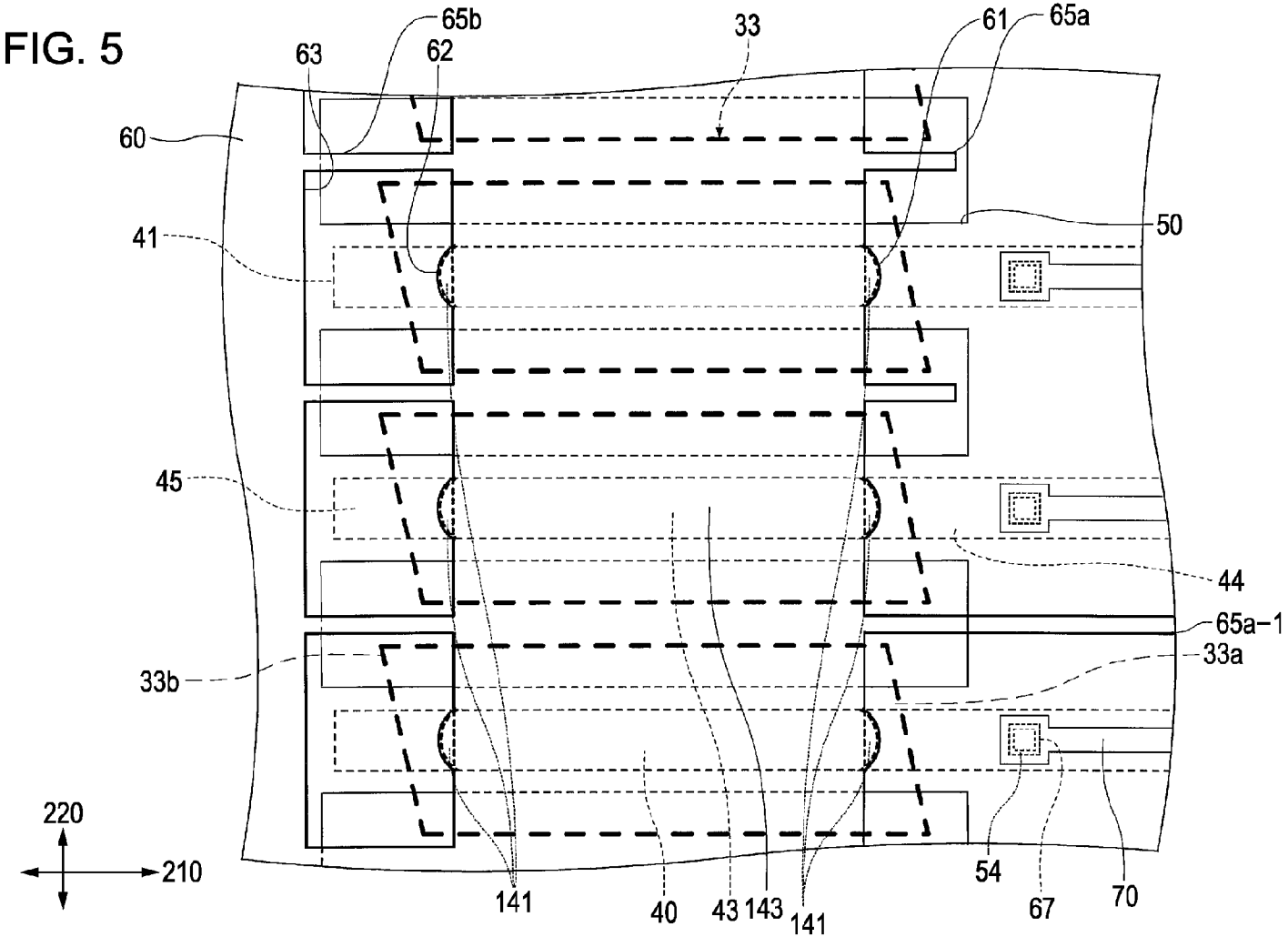
FIG. 5 is a plan view diagrammatically showing a principal portion of the liquid ejecting head according to a modification.

The liquid ejecting head 300 according to the first embodiment and the liquid ejecting head 302 according to the second embodiment may be modified in a various manners. In the following description, an example of a modification applicable to the liquid ejecting head 300 according to the first embodiment and the liquid ejecting head 302 according to the second embodiment. FIG. 5 is a plan view diagrammatically showing a principal portion of the liquid ejecting head according to the modification.

In the liquid ejecting head according to the modification, the end areas 141 of the second conductive layer 60 are each reduced arcuately and monotonously in width from the both ends in the second direction 220 as it goes toward the ends in the first direction 210 as shown in FIG. 5.

In the liquid ejecting head according to the modification shown in FIG. 5, since the angle at the boundaries of the overlapped areas 143 is an obtuse angle when viewed from the third direction 230, the local concentration of the strain on the portion near the boundaries of the overlapped areas 143 can be alleviated. Therefore, the liquid ejecting head improved in durability is realized.

As shown in FIG. 5, the second conductive layer 60 may include the end areas 141 on both end sides of the overlapped areas 143 in the first direction 210. Accordingly, the local concentration of the strain on the both ends of the overlapped areas 143 near the boundaries thereof can be alleviated. In addition, the stress can easily be well balanced at the both ends of the overlapped areas 143. Therefore, the liquid ejecting head improved in durability is realized.

Furthermore, the second conductive layer 60 may be provided so that the shapes of the overlapped areas 143 become line symmetry as shown in FIG. 5. Accordingly, the stress can be well balanced further easily at the both ends of the overlapped areas 143. Therefore, the liquid ejecting head improved in durability is realized.

In the first embodiment, the second embodiment, and the modification described above, the ink jet recording head which discharges ink has been described as the liquid ejecting head. However, the invention may be applied generally to liquid ejecting heads and liquid ejecting apparatuses employing a piezoelectric element. As the liquid ejecting head, for example, print heads used for an image printing apparatus such as printers, coloring material ejecting heads used for manufacturing color filters such as liquid crystal displays, electrode material ejecting heads used for forming electrodes for displays such as organic EL displays or FED (surface emission-type displays), and also biological organic substance ejecting heads used for manufacturing biological chips are exemplified.

1-4. Method of Manufacturing Liquid Ejecting Head

Referring now to the drawings, a method of manufacturing the liquid ejecting head will be described with reference to the liquid ejecting head 302 according to the second embodiment as an example. The liquid ejecting head 300 according to the first embodiment and the liquid ejecting head according to the modification may also be manufactured in the same method of manufacturing as the liquid ejecting head 302 according to the second embodiment.

FIG. 6 to FIG. 11 are cross-sectional views for explaining the method of manufacturing the liquid ejecting head 302 according to the second embodiment.

The method of manufacturing the liquid ejecting head 302 according to the second embodiment is different between a case where monocrystal silicon or the like is used as the material for forming the pressure generating chamber substrate 10 and the nozzle plate 20 and a case where the stainless or the like is used. In the following description, the method of manufacturing the liquid ejecting head employing the monocrystal silicon will be described as an example. Therefore, the method of manufacturing the liquid ejecting head 302 according to the second embodiment is not limited to the method of manufacturing described below, and may include a process such as a known electroforming method if nickel, stainless steel, stainless or the like is employed as the material. The order of the respective steps is not limited to the method of manufacturing described later.

Figure 6A:
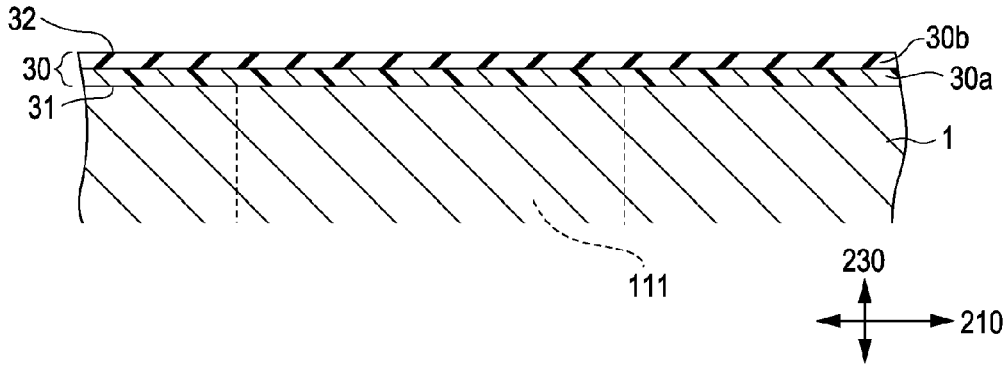
FIG. 6A-6C is a cross-sectional view for explaining a method of manufacturing the liquid ejecting head 302 according to a second embodiment.

First of all, as shown in FIG. 6A, the diaphragm 30 is formed on a prepared substrate 1 formed of monocrystal silicon. As shown in FIG. 6A, in the manufacturing process described later, the area of the substrate 1 in which the pressure generating chamber 11 is formed is defined as an area 111. The diaphragm 30 is formed by a known film forming technology. As shown in FIG. 6A, for example, the diaphragm 30 may be formed by forming a resilient layer 30*a* which constitutes a resilient plate by a spattering process or the like, and then forming an insulating layer 30*b* on the resilient layer 30*a* by the sputtering process. For example, zirconium oxide may be used for the resilient layer 30*a* and silicon oxide may be used for the insulating layer 30*b*. Here, the surface of the diaphragm 30 on the side of the substrate 1 is defined as the first surface, and a back side of the first surface 31 is defined as the second surface 32.

Figure 6B:
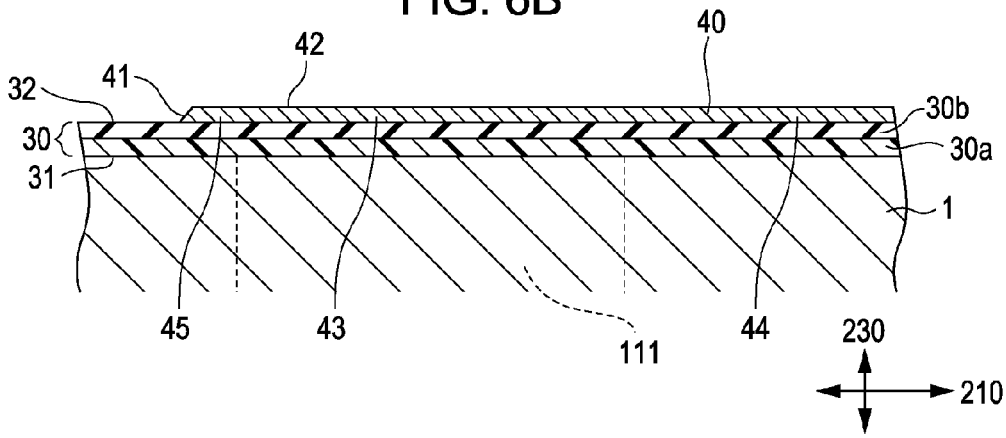

After having formed the diaphragm 30, the first conducive layer 40 is formed by forming a conductive layer the second surface 32 of the diaphragm 30, and then performing a patterning process by etching as shown in FIG. 6B. Here, each of the first conducive layers 40 is patterned so as to extend to a portion out of an area overlapping with the area 111 and cover the second surface 32 of the diaphragm 30 at least at one end in the first direction 21, and cover the second surface 32 of the diaphragm 30 within the area overlapping with the area 111 in the second direction 220 when viewed from the third direction 230. The first conducive layers 40 are patterned so as to be formed one for each of the areas 111.

When the first conducive layers 40 are patterned, the end surfaces 41 on one side in the third direction 230 are formed to have a tapered side surface as shown in FIG. 6B. Accordingly, the end surfaces 41 are formed. Also, after having patterned the first conducive layers 40, the upper surfaces 42 are also formed simultaneously with the end surface 41. The positions of the end surfaces 41 may be out of the areas overlapping with the areas 111 or, although not shown, may be within the areas overlapping with the areas 111 when viewed from the second direction 220.

Since detailed configurations of the first conducive layers 40 are described above, they will not be described here. The first conducive layers 40 may be formed by a known film forming technology. For example, the first conducive layers 40 may be formed by forming a conductive layer (not shown) by laminating platinum (Pt), iridium (Ir) and the like by the sputtering process or the like, and etching the conductive layer into a predetermined shape.

Figure 6C:
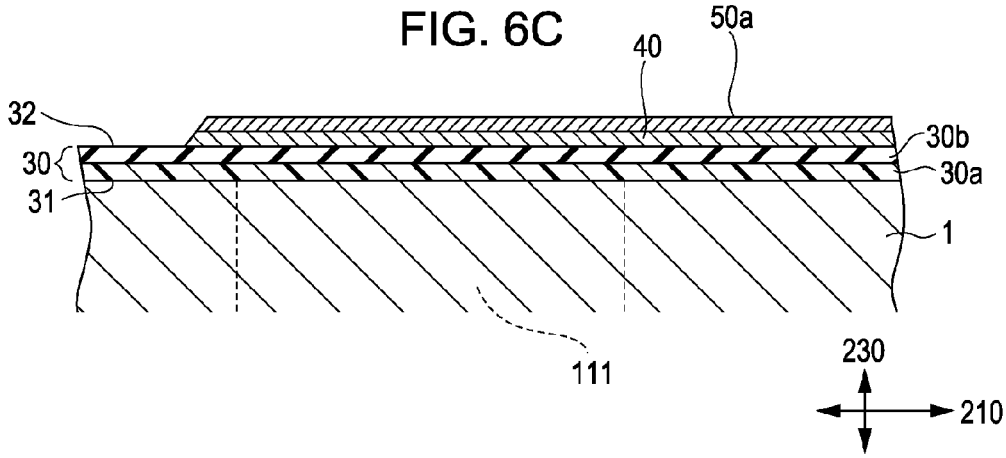

As shown in FIG. 6C, an etching protecting film 50*a* may be formed on the conductive layer before the conductive layer for forming the first conducive layers 40 is patterned by the etching. The etching protecting film 50*a* is a piezoelectric member formed of the same piezoelectric material as the piezoelectric layers 50 described later. The etching protecting film 50*a* may be formed at least in an area in which the first conducive layers 40 to be patterned in a desired shape are formed. In this configuration, the surfaces of the first conducive layers 40 can be protected from being chemically damaged by etchant used in the etching process for patterning the first conducive layers 40.

Figure 7A:
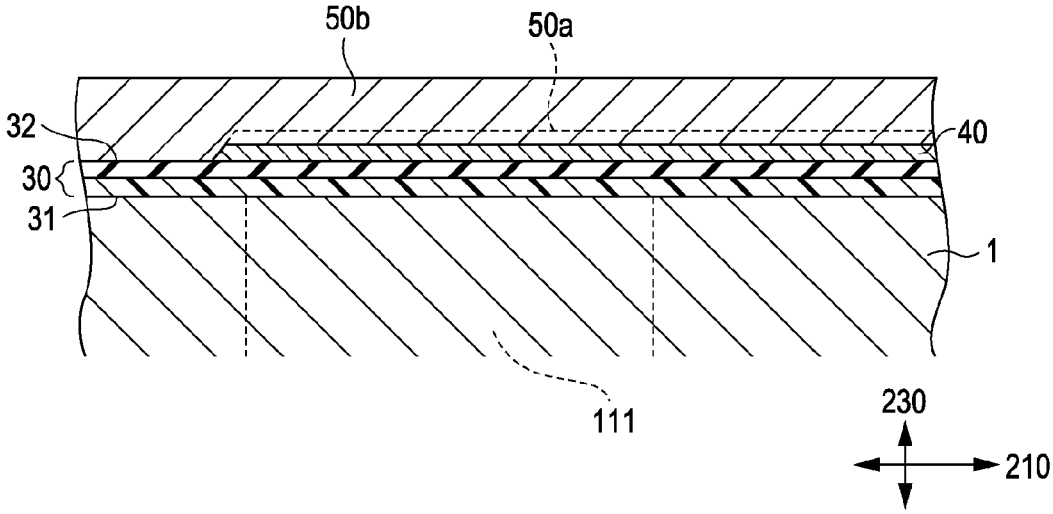
FIG. 7A-7B is a cross-sectional view for explaining a method of manufacturing the liquid ejecting head 302 according to the second embodiment.

Subsequently, as shown in FIG. 7A, a piezoelectric layer 50*b* is formed so as to cover the first conducive layers 40. By patterning the piezoelectric layer 50*b*, the piezoelectric layers 50 are formed. The detailed description will be given later. The piezoelectric layer 50*b* may be formed by a known film forming technology. The piezoelectric layer 50*b* may be formed for example, by applying precursor, which is a known piezoelectric material, on the second surface 32 of the diaphragm 30 and applying heat treatment thereon. The precursor to be used is not specifically limited as long as it is subjected to a polarization treatment after having baked in the heat treatment so as to demonstrate piezoelectric properties and, for example, a precursor of lead zirconate titanate may be employed. When the etching protecting film 50*a* is formed, since the etching protecting film 50*a* is formed of the same piezoelectric material as the piezoelectric layer 50*b* (the piezoelectric layer 50), the etching protecting film 50*a* can be integrated with the piezoelectric layer 50*b* after the baking.

Figure 7B:
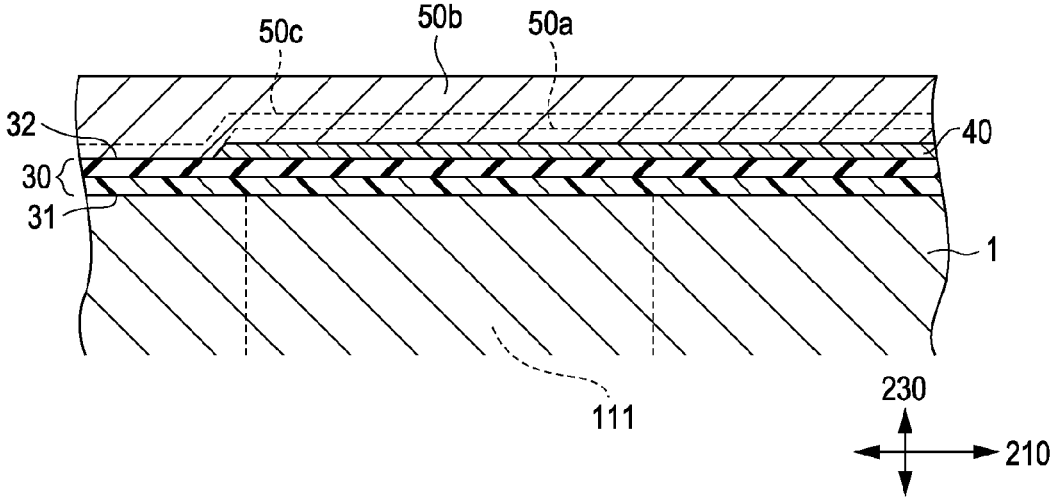

Here, for example, when the piezoelectric layer 50*b* (the piezoelectric layer 50) is formed of lead zirconate titanate, it is also possible to apply the precursor as the piezoelectric material after having formed a intermediate titanium layer 50*c* formed of titanium entirely over the surface of the second surface 32 of the diaphragm 30 as shown in FIG. 7B. Accordingly, when promoting crystal growth of the piezoelectric layer 50*b* by performing the heating treatment of the precursor, an interface where the crystal growth of the precursor is promoted may be unified with the intermediate titanium layer 50*c*. In other words, the crystal growth of the piezoelectric layer 50*b* on the diaphragm 30 is eliminated. In this configuration, the controllability of the crystal growth of the piezoelectric layer 50*b* is enhanced, so that the piezoelectric layer 50*b* becomes a piezoelectric crystal having higher degree of orientation. The intermediate titanium layer 50*c* may be taken into the crystal of the piezoelectric layer 50*b* when being subjected to the heat treatment.

Figure 8A:
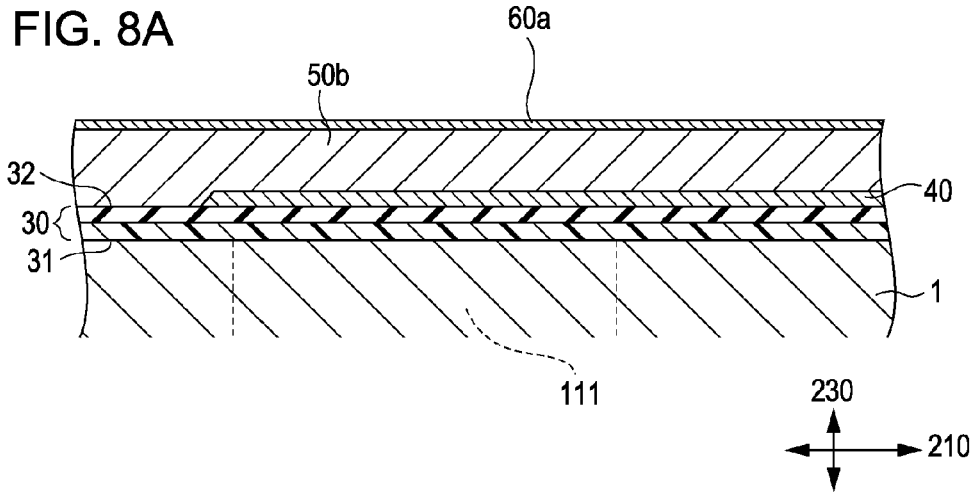
FIG. 8A-8C is a cross-sectional view for explaining a method of manufacturing the liquid ejecting head 302 according to the second embodiment.
Figure 8B:
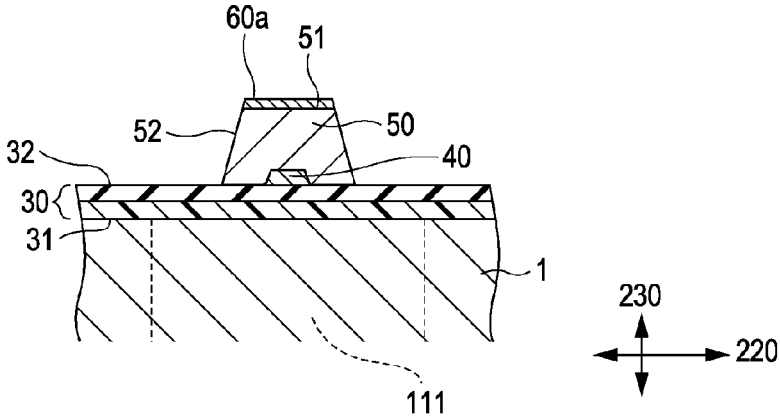

Subsequently, as shown in FIG. 8A, a mask layer 60*a* having conductivity may be formed so as to cover the piezoelectric layer 50*b* before the piezoelectric layer 50*b* is patterned into a desired shape by etching process. The mask layer 60*a* may be formed by a known film forming technology. For example, the mask layer 60*a* may be formed by laminating iridium (Ir), platinum (Pt), gold (Au), palladium (Pd), nickel (Ni), tungsten (W) or the like by spattering process or the like. As shown in FIG. 8B, after having formed the mask layer 60*a*, the piezoelectric layer 50*b* is patterned by the etching process, and the piezoelectric layer 50 is patterned into a desired form. Here, by forming the mask layer 60*a*, the mask layer 60*a* acts as a hard mask in the etching process. Therefore, the side surfaces 52 of a tapered shape can be formed easily on the piezoelectric layer 50 as shown in FIG. 8B. Since detailed configurations of the piezoelectric layer 50 are described above, they will not be described here.

Figure 8C:
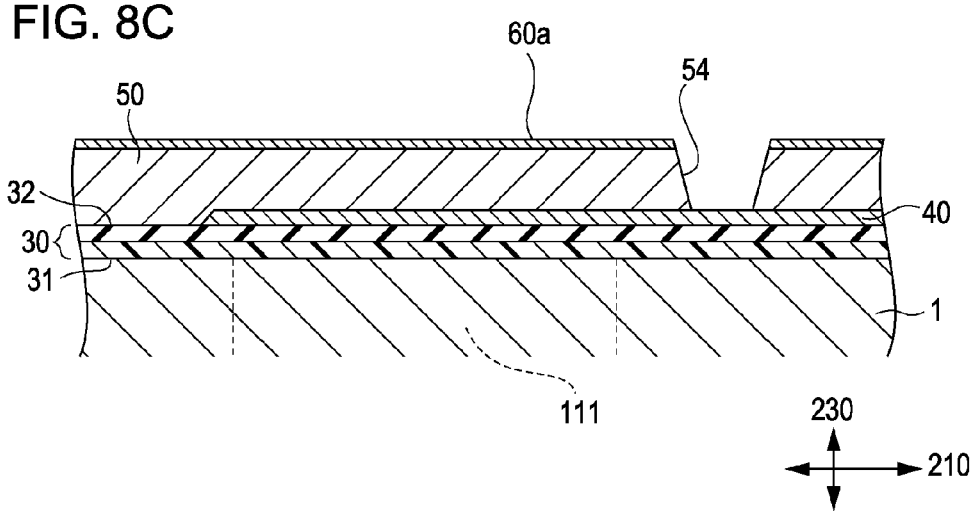

As shown in FIG. 8C, when etching the piezoelectric layer 50, the openings 54 which expose the first conducive layers 40 are formed in areas in the first conducive layers 40 which do not overlap with the areas 111 simultaneously. The openings 54 are formed at position apart from the second conductive layer 60.

Figure 9A:
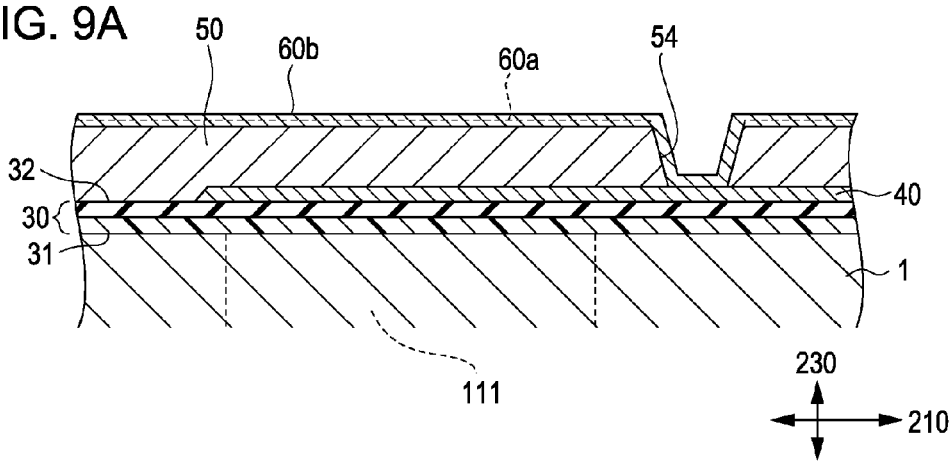
FIG. 9A-9B is a cross-sectional view for explaining a method of manufacturing the liquid ejecting head 302 according to the second embodiment.

Subsequently, as shown in FIG. 9A, the conductive layer 60*b* is formed so as to cover the piezoelectric layer 50 and the opening 54. The conductive layer 60*b* may be formed by a known film forming technology. For example, the conductive layer 60*b* may be formed by laminating iridium (Ir), platinum (Pt), gold (Au), palladium (Pd), nickel (Ni), tungsten (W), copper (Cu), silver (Ag) or the like by spattering process or the like.

When the mask layer 60*a* and the conductive layer 60*b* are formed of the same material, the mask layer 60*a* and the conductive layer 60*b* are integrated. Since only one type of the film forming material is required, the mask layer 60*a* and the conductive layer 60*b* may be formed in a simple process.

When the mask layer 60*a* and the conductive layer 60*b* are formed of different materials, the mask layer 60*a* may be formed of a material suitable for aiding the formation of the interface between the piezoelectric layer 50 and the second conductive layer 60, and the conductive layer 60*b* may be formed of a material suitable for taking charge of conductivity.

Figure 9B:
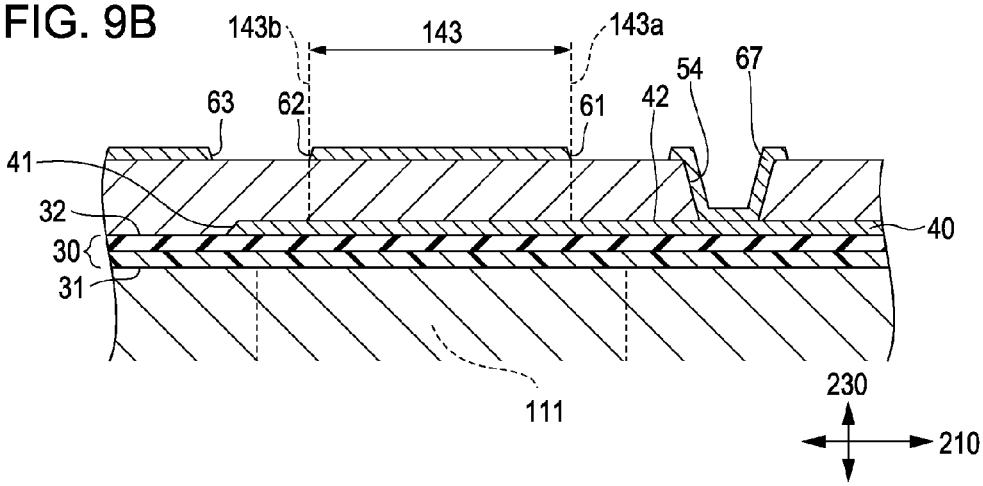

Subsequently, as shown in FIG. 9B, the conductive layer 60*b* is patterned into a desired shape by etching to form the second conductive layer 60. In the process of patterning the conductive layer 60*b*, the conductive layer 60*b* is patterned to have end areas 141 each reduced in width in the second direction 220 as it goes toward the end in the first direction 210 on one of the both ends of the overlapped areas 143, which overlap with the areas 111, the first conducive layers 40 and the piezoelectric layers 50, as shown in FIG. 4A.

In the process of patterning the conductive layer 60*b*, as shown in FIG. 9B, in an area overlapping at least with the areas 111 when viewed from the third direction 230, the conductive layer 60*b* is patterned to cover at least part of the piezoelectric layers 50 so as to overlap with part of the first conducive layers 40 in the first direction 210 and with the first conducive layers 40 in the second direction 220 in the areas overlapping at least with the areas 111 when viewed from the third direction 230. Furthermore, in the process of patterning the conductive layer 60*b*, the conductive layer 60*b* is patterned so that the second conductive layer 60 has the extending portion 65*a* and 65*b* extending to both sides in the first direction 210 in at least part of the areas interposed between the adjacent first conducive layers 40 when viewed from the third direction 230 as shown in FIG. 4A and FIG. 4C.

The second conductive layer 60 is formed continuously so as to cover the plurality of piezoelectric layers 50 respectively. In this configuration, when the second conductive layer 60 is connected to the common electrode for example via the wirings or the like not shown, the second conductive layer 60 can be used as a common upper electrode of the piezoelectric element 100. Since detailed configurations of the second conducive layer 60 are described above, they will not be described here. As described thus far, by patterning the second conductive layer 60, the piezoelectric layers 50 corresponding to the overlapped areas 143 may be defined on the upper surfaces 42 of the first conducive layers 40 from the arrangement of the end portions 61 and the end portions 62.

In the process of patterning the second conductive layer 60, the conductive layer 60*b* may be patterned so as to cover at least the opening 54 as shown in FIG. 9B. In other words, the third conductive layers 67 may be formed by not removing the conductive layer 60*b* formed above the openings 54. In this configuration, when, performing an exposing treatment and a developing treatment and performing etching using the resist layer as a mask after having formed a resist film by applying resist for example, organic alkali developing fluid, organic separating fluid, and washing fluid, and the like are used. Therefore, by not removing the conductive layer 60*b* formed above the openings 54 (in other words, by forming the third conductive layers 67), provability of over-etching of the surfaces of the first conducive layers 40 in the openings 54 is eliminated. In addition, the exposed portions of the first conducive layers 40 in the openings 54 are prevented from chemically damaged by being exposed to the organic separating fluid, the cleaning fluid and the like after the etching. In the method of manufacturing according to the embodiments, the third conductive layers 67 are not essential configurations, and it is also possible to remove the conductive layer 60*b* in the openings 54 and not to form the third conductive layers 67.

Figure 10:
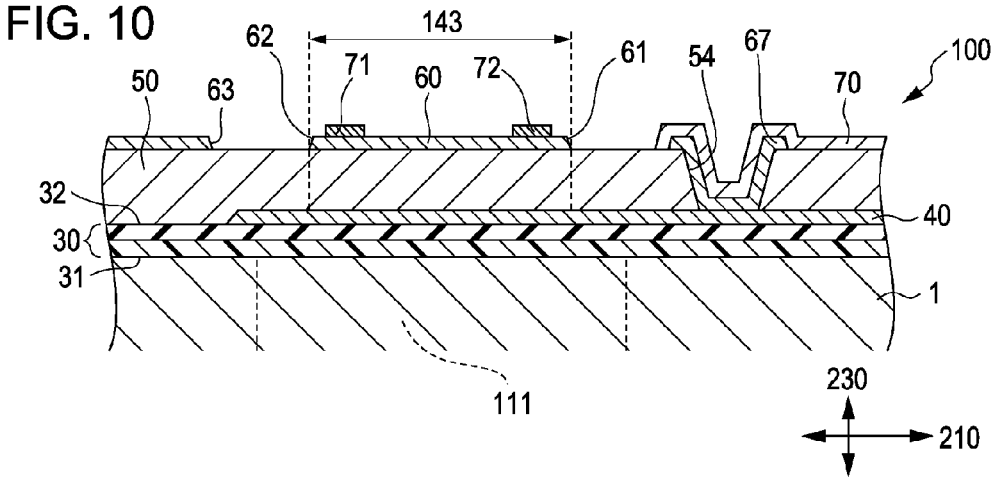
FIG. 10 is a cross-sectional view for explaining a method of manufacturing the liquid ejecting head 302 according to the second embodiment.

Subsequently, as shown in FIG. 10, the fourth conductive layers 70 are formed so as to cover at least the openings 54. When the third conductive layers 67 are formed, the fourth conductive layers 70 may be formed so as to be electrically connected to the third conductive layers 67. At this time, as shown in FIG. 10, when patterning the fourth conductive layers 70, the first solid layer 71 and the second solid layer 72 may be formed simultaneously so as to achieve a desired arrangement. The fourth conductive layer 70 as well as the second solid layer 72 and the second solid layer 72 may be formed using a known film forming technology. For example, the first conducive layers 70 as well as the first solid layer 71 and the second solid layer 72 may be formed by forming a conductive layer (not shown) by laminating gold (Au), nickel-chrome alloy (Ni—Cr) and the like by the sputtering process or the like, and etching the conductive layer into a predetermined shape. The fourth conductive layers 70 may be connected to an external drive circuit, not shown. Since the detailed descriptions of the first solid layer 71 and the second solid layer 72 are given above, they will not be described again in detail.

Figure 11A:
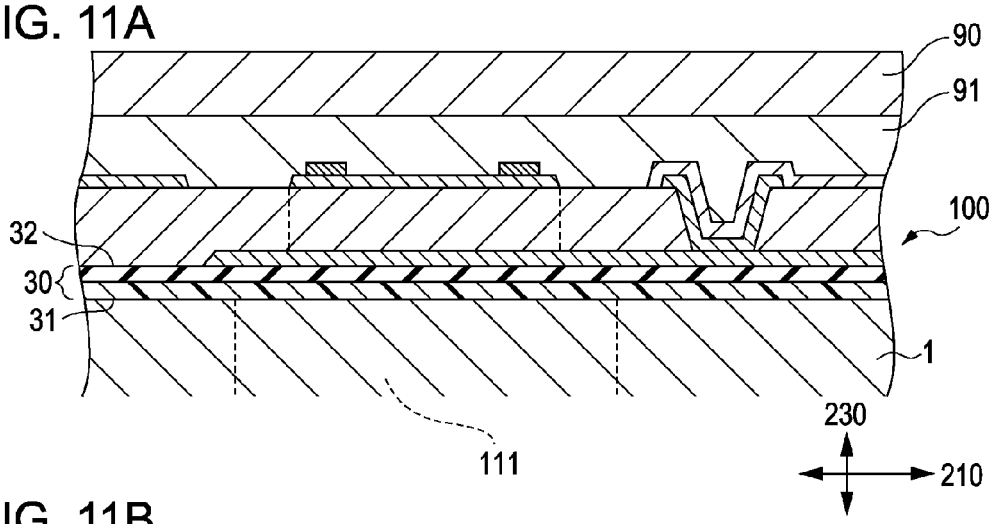
FIG. 11A-11C is a cross-sectional view for explaining a method of manufacturing the liquid ejecting head 302 according to the second embodiment.
Figure 11B:
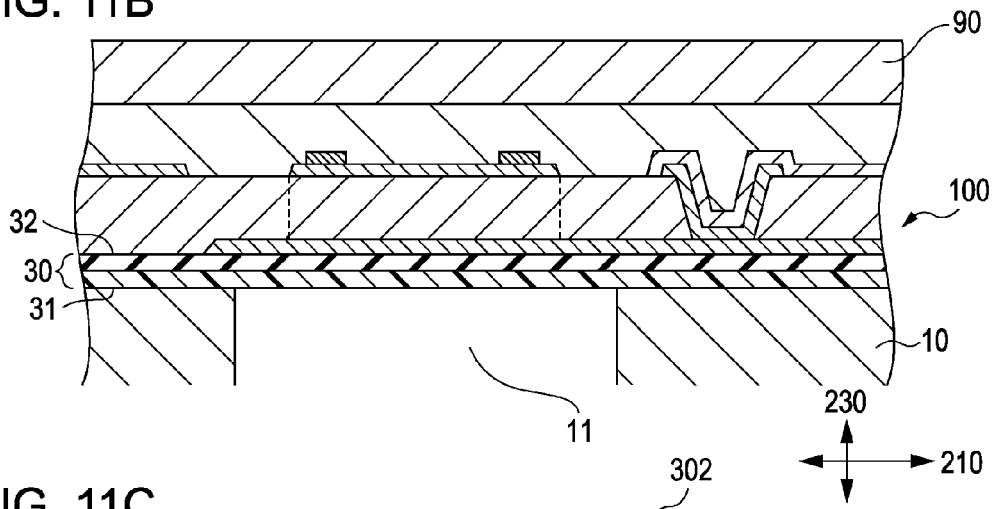
Figure 11C:
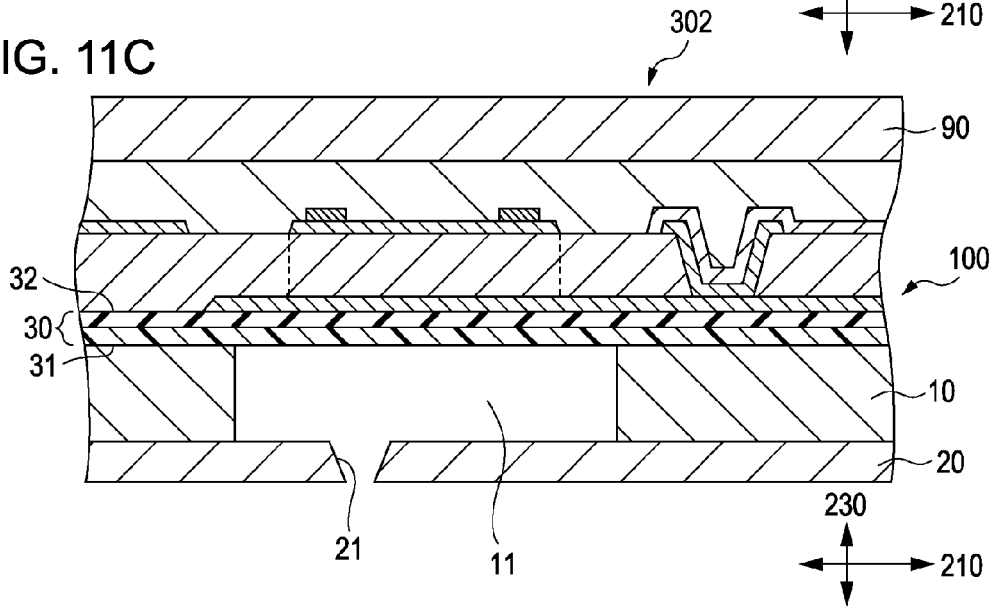

As shown in FIG. 11A, the sealing plate 90 formed with a sealed area 91 is mounted on the piezoelectric element 100 from above. Here, the piezoelectric element 100 can be sealed within the sealed area 91. The sealing plate 90 may seal the piezoelectric element 100, for example, with an adhesive agent. Subsequently, as shown in FIG. 11B, the substrate 1 is reduced in thickness to a predetermined thickness to partition the pressure generating chambers 11 or the like. For example, by forming a mask (not shown) on the substrate 1 in a predetermined thickness on the side opposite from the surface where the diaphragm 30 is formed to achieve patterning in a desired shape, and performing an etching process, the pressure generating chambers 11 are formed and the wall portions 12 the supply channels 13 the communicating channels 14 and the reservoir 15 are partitioned. According to the method described thus far, the pressure generating chamber substrate 10 having the pressure generating chambers 11 may be formed below the diaphragm 30. After having formed the pressure generating chamber substrate 10, the nozzle plate 20 having the nozzle orifices 21 are joined to a predetermined position using, for example, an adhesive agent or the like, as shown in FIG. 11C. Accordingly, the nozzle orifices 21 communicate with the pressure generating chambers 11.

With any one of the methods described thus far, the liquid ejecting head 302 according to the second embodiment is manufactured. As described above, the method of manufacturing the liquid ejecting head 302 according to the second embodiment is not limited to the method of manufacturing described above, and the pressure generating chamber substrate 10 and the nozzle plate 20 may be formed integrally using the electroforming method or the like.

2. Liquid Ejecting Apparatus

Figure 12:
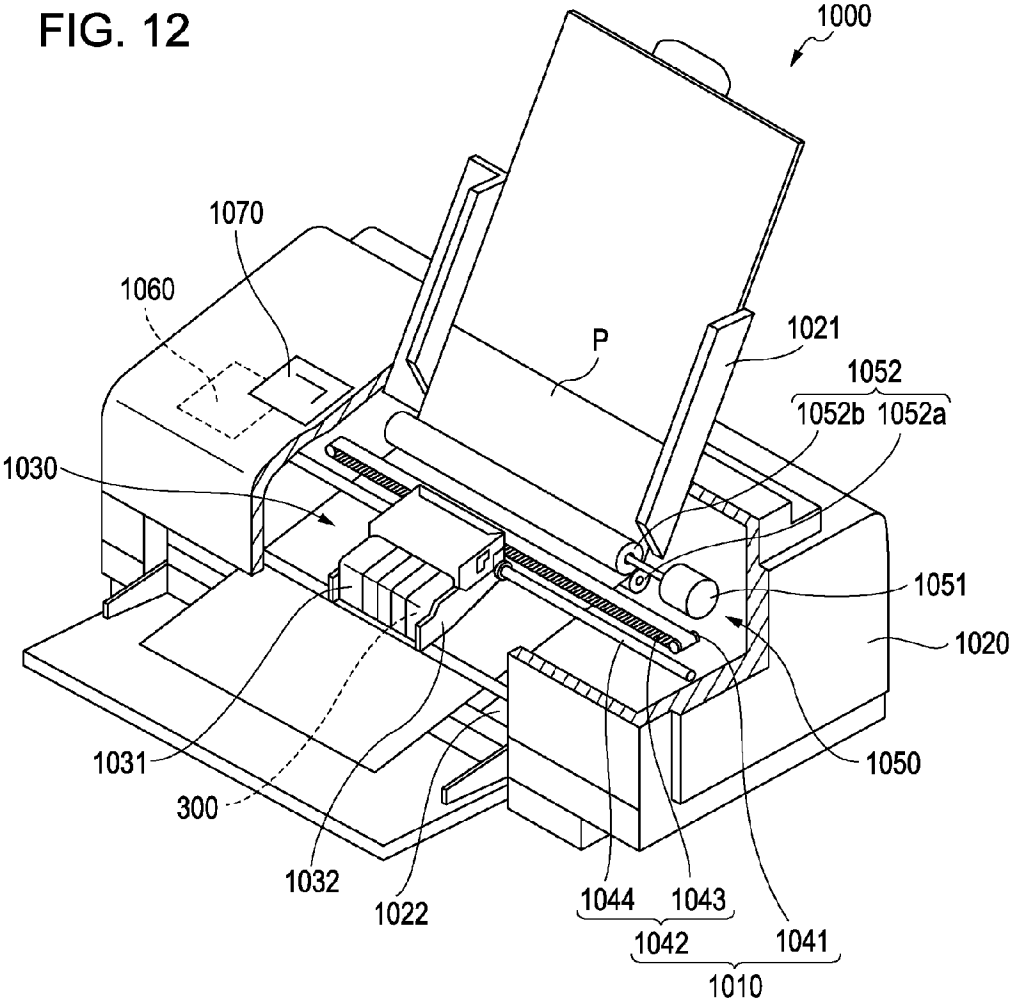
FIG. 12 is a perspective view schematically showing a liquid ejecting apparatus 1000 according to the embodiment.

Subsequently, the liquid ejecting apparatus according to an embodiment will be described. A liquid ejecting apparatus 1000 according to this embodiment includes the liquid ejecting head 300 according to the first embodiment. Here, a case where the liquid ejecting apparatus 1000 according to the embodiment is an ink jet printer will be described. FIG. 12 is a perspective view schematically showing the liquid ejecting apparatus 1000 according to the embodiment.

The liquid ejecting apparatus 1000 may include a head unit 1030, a drive unit 1010, and a control unit 1060. The liquid ejecting apparatus 1000 includes an apparatus body 1020, a paper feeding unit 1050, a tray 1021 for setting recording sheets P, a discharge port 1022 for discharging paper P, and an operating panel 1070 arranged on an upper surface of the apparatus body 1020.

The head unit 1030 includes, for example, an ink jet print head (hereinafter, referred to simply as "head") which is made up of the liquid ejecting head 300 described above. The head unit 1030 further includes an ink cartridge 1031 configured to supply ink to the head and a carrying unit (carriage) 1032 having the head and the ink cartridge 1031 mounted thereon.

The drive unit 1010 may allow the head unit 1030 to make a reciprocating motion. The drive unit 1010 includes a carriage motor 1041 which serves as a drive source of the head unit 1030 and a reciprocating mechanism 1042 configured to cause the head unit 1030 to make a reciprocating motion upon receipt of the rotation of the carriage motor 1041.

The reciprocating mechanism 1042 includes a carriage guide shaft 1044 supported at both ends thereof by a frame (not shown), and a timing belt 1043 extending in parallel to the carriage guide shaft 1044. The carriage guide shaft 1044 supports the carriage 1032 while allowing the carriage 1032 to make a reciprocating motion freely. Furthermore, the carrying unit 1032 is fixed to a part of the timing belt 1043. When the timing belt 1043 is caused to travel by the operation of the carriage motor 1041, the head unit 1030 makes a reciprocating motion by being guided by the carriage guide shaft 1044. During this reciprocating motion, ink is discharged as needed from the head and printing on the recording sheet P is achieved.

The control unit 1060 is capable of controlling the head unit 1030, the drive unit 1010, and a paper feeding unit 1050.

The paper feeding unit 1050 is capable of feeding the recording sheet P from the tray 1021 toward the ink cartridge 1031. The paper feeding unit 1050 includes a paper feeding motor 1051 as a power source thereof, and a paper feeding roller 1052 which is rotated by the operation of the paper feeding motor 1051. The paper feeding roller 1052 includes a driven roller 1052*a* and a drive roller 1052*b* opposing to each other with the intermediary of a feeding path for the recording sheet P. The drive roller 1052*b* is coupled to the paper feeding motor 1051. When the paper feeding unit 1050 is driven by the control unit 1060, the recording sheet P is fed to pass through the underside of the head unit 1030.

The head unit 1030, the drive unit 1010, the control unit 1060 and the paper feeding unit 1050 are provided inside the apparatus body 1020.

The liquid ejecting apparatus 1000 may have the liquid ejecting head 300 improved in durability according to the first embodiment. Therefore, the liquid ejecting apparatus 1000 improved in durability is obtained.

It is also possible to configure the liquid ejecting apparatus 1000 using the liquid ejecting head 302 according to the second embodiment and the liquid ejecting head according to the modification. In this case as well, the liquid ejecting apparatus 1000 improved in durability is obtained from the same reason as the above-described reasons.

In the example described above, the case where the liquid ejecting apparatus 1000 is the ink jet printer has been described. However, the liquid ejecting apparatus 1000 according to the embodiment of the invention may be used as a liquid ejecting apparatus for the industrial use. As the liquid (liquid-state material) discharged in this case, those obtained by adjusting various functional materials to have a suitable viscosity using solvent or dispersing medium or those containing metal flakes may be used.

The embodiments and the modification described above are examples only, and the invention is not limited thereto. For example, a plurality of the respective embodiments and the respective modifications may be combined as needed.

The present invention is not limited to the embodiment described above, and various modifications may be made. For example, the invention includes the substantially same configuration as the configuration described in the embodiments (for example, the configuration in which the function, the method and the result are the same, or the configurations having the same object or the effect). The invention includes also the configuration in which portions which are not essential in the configuration described in the embodiment are replaced. The invention also includes configurations which achieve the same effects and advantages as the configurations described in the embodiments, and configurations which are able to achieve the same object. The invention includes also the configuration including known techniques added to the configurations described in the embodiments.

What is claimed is:

1. A liquid ejecting head comprising:

a pressure generating chamber substrate having a plurality of pressure generating chambers which communicate with nozzle orifices, respectively; and a piezoelectric element including first conductive layers, piezoelectric layers, and a second conductive layer provided in sequence above the pressure generating chamber substrate, wherein the piezoelectric element includes overlapped areas where the pressure generating chambers, the first conductive layers, the piezoelectric layers and the second conductive layer overlap one another in plan view, the first conductive layers each have a longitudinal direction in a first direction and a short side direction in a second direction orthogonal to the first direction in the overlapped area and are provided for each of the overlapped areas, the second conductive layer is provided continuously so as to overlap with a plurality of the pressure generating chambers in plan view and includes end areas on the side of at least one of the ends of the overlapped areas in the first direction, and the end areas are each reduced in width in the second direction as it goes toward the end in the first direction.

2. The liquid ejecting head according to claim 1, wherein each of the end areas is reduced in width from both sides in the second direction as it goes toward the end in the first direction.

3. The liquid ejecting head according to claim 1, wherein the second conductive layer includes the end areas on the sides of both ends of the overlapped areas.

4. The liquid ejecting head according to claim 1, wherein the second conductive layer is provided so that shapes of the overlapped areas become line symmetry.

5. The liquid ejecting head according to claim 1, wherein the second conductive layer includes two end areas on one side and the other side in the first direction in each of the overlapped areas.

6. The liquid ejecting head according to claim 1, comprising:

a first solid layer and a second solid layer provided on the second conductive layer, wherein the first solid layer is provided so as to overlap with the overlapped areas on the side of one of the ends of the overlapped areas in the first direction in plan view, and the second solid layer is provided so as to overlap with the overlapped areas on the sides of the other ends of the overlapped areas in the first direction in plan view.

7. A liquid ejecting apparatus comprising the liquid ejecting head according to claim 1.

8. The liquid ejecting apparatus comprising the liquid ejecting head according to claim 2.

9. The liquid ejecting apparatus comprising the liquid ejecting head according to claim 3.

10. The liquid ejecting apparatus comprising the liquid ejecting head according to claim 4.

11. The liquid ejecting head according to claim 5, wherein the second conductive layer includes extending portions which extend from at least part of an area interposed between the adjacent overlapped areas to both sides in the first direction.

12. The liquid ejecting apparatus comprising the liquid ejecting head according to claim 5.

13. The liquid ejecting apparatus comprising the liquid ejecting head according to claim 6.

14. The liquid ejecting apparatus comprising the liquid ejecting head according to claim 11.

* * * * *